US007066097B2

(12) United States Patent
Gayhart et al.

(10) Patent No.: US 7,066,097 B2
(45) Date of Patent: Jun. 27, 2006

(54) WORKSURFACE SUPPORT SYSTEM WITH POWER AND COMMUNICATION CAPABILITY AND FRONT AND REAR ACCESS COVERS

(75) Inventors: Jon W. Gayhart, DePere, WI (US); Scott J. Williams, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 266 days.

(21) Appl. No.: 10/355,993

(22) Filed: Jan. 31, 2003

(65) Prior Publication Data

US 2004/0149177 A1 Aug. 5, 2004

Related U.S. Application Data

(60) Provisional application No. 60/353,696, filed on Feb. 1, 2002.

(51) Int. Cl.
*A47B 37/00* (2006.01)

(52) U.S. Cl. ..... 108/50.02; 312/223.6

(58) Field of Classification Search ..... 312/223.6, 312/223.3, 194; 108/50.02, 50.01; 174/48, 174/49

See application file for complete search history.

(56) References Cited

U.S. PATENT DOCUMENTS

| | | | |
|---|---|---|---|
| 3,674,230 | A | 7/1972 | Propst |
| 3,883,202 | A | 5/1975 | Konig |
| 3,921,539 | A | 11/1975 | Berger |
| 4,060,294 | A | 11/1977 | Haworth et al. |
| 4,066,305 | A | 1/1978 | Gazarek |
| 4,094,256 | A | 6/1978 | Holper et al. |
| 4,224,769 | A | 9/1980 | Ball et al. |
| 4,296,981 | A | 10/1981 | Hildebrandt et al. |
| D263,189 | S | 3/1982 | Beals |
| 4,323,291 | A | 4/1982 | Ball |
| 4,370,008 | A | 1/1983 | Haaworth et al. |
| 4,372,629 | A | 2/1983 | Propst et al. |

(Continued)

FOREIGN PATENT DOCUMENTS

| | | |
|---|---|---|
| DE | 7825906 | 1/1979 |

(Continued)

OTHER PUBLICATIONS

System 3000 Assembly Instructions, Krueger International, Inc., 1330 Bellevue St., Green Bay, WI 54308-8100, 1991.

(Continued)

*Primary Examiner*—José V. Chen
(74) *Attorney, Agent, or Firm*—Boyle Frederickson Newholm Stein & Gratz S.C.

(57) ABSTRACT

A table or desk includes a worksurface and leg structure, and a wire management arrangement located below the worksurface. The wire management arrangement includes upper and lower wire management members that support wires or cables for providing power and/or communication capability to the worksurface, and front and rear access covers which are movable between open and closed positions for providing access to the wire management members. The rear access cover provides access to the lower wire management member, and engages the upper wire management member when in the closed position. A portion of the upper wire management member above the rear access cover is exposed, to mount power outlets that can be accessed from the rear of the worksurface. The front access cover is engaged with the worksurface when in the closed position, and provides access to both the upper and lower wire management members when in the open position.

18 Claims, 26 Drawing Sheets

U.S. PATENT DOCUMENTS

| | | | | | |
|---|---|---|---|---|---|
| 4,382,642 | A | | 5/1983 | Burdick | |
| 4,422,385 | A | * | 12/1983 | Rutsche et al. | 108/153.1 |
| 4,433,884 | A | | 2/1984 | Edwards et al. | |
| RE31,733 | E | | 11/1984 | Haworth et al. | |
| 4,535,703 | A | | 8/1985 | Henriott et al. | |
| 4,627,364 | A | | 12/1986 | Klein et al. | |
| 4,734,826 | A | | 3/1988 | Wilson et al. | |
| 4,748,913 | A | | 6/1988 | Favaretto et al. | |
| 4,762,072 | A | | 8/1988 | Boundy et al. | |
| 4,792,881 | A | | 12/1988 | Wilson et al. | |
| 4,828,513 | A | | 5/1989 | Morrison et al. | |
| 4,852,500 | A | | 8/1989 | Ryburg et al. | |
| 4,883,330 | A | | 11/1989 | Armstrong et al. | |
| 5,024,167 | A | * | 6/1991 | Hayward | 108/50.02 |
| 5,050,267 | A | | 9/1991 | Quest | |
| 5,094,174 | A | | 3/1992 | Grund et al. | |
| 5,103,741 | A | | 4/1992 | Grund et al. | |
| 5,144,896 | A | | 9/1992 | Fortsch | |
| 5,186,425 | A | | 2/1993 | Keusch et al. | |
| 5,220,871 | A | | 6/1993 | Grund et al. | |
| 5,226,705 | A | | 7/1993 | Rorke et al. | |
| 5,230,552 | A | | 7/1993 | Schipper et al. | |
| 5,231,562 | A | | 7/1993 | Pierce et al. | |
| 5,237,935 | A | | 8/1993 | Newhouse et al. | |
| 5,272,988 | A | | 12/1993 | Kelley et al. | |
| 5,277,131 | A | | 1/1994 | Fortsch | |
| 5,279,233 | A | | 1/1994 | Cox | |
| 5,337,657 | A | | 8/1994 | Diffrient | |
| 5,354,027 | A | | 10/1994 | Cox | |
| D352,845 | S | | 11/1994 | Hellwig et al. | |
| 5,533,457 | A | | 7/1996 | Cox | |
| 5,606,920 | A | | 3/1997 | Meyer et al. | |
| 5,878,673 | A | | 3/1999 | Kramer et al. | |
| 5,901,513 | A | | 5/1999 | Mollenkopf et al. | |
| 5,934,201 | A | | 8/1999 | Diffrient | |
| 5,957,062 | A | | 9/1999 | Cox et al. | |
| 5,971,509 | A | | 10/1999 | Deimen et al. | |
| 5,988,076 | A | | 11/1999 | Vander Park | |
| 6,003,447 | A | | 12/1999 | Cox et al. | |
| D422,813 | S | | 4/2000 | Kane et al. | |
| D423,832 | S | | 5/2000 | Kane et al. | |
| 6,202,567 | B1 | | 3/2001 | Funk et al. | |
| D450,564 | S | | 11/2001 | Kane et al. | |
| 6,435,106 | B1 | | 8/2002 | Funk et al. | |
| 6,448,498 | B1 | * | 9/2002 | King et al. | 174/99 R |

FOREIGN PATENT DOCUMENTS

| | | |
|---|---|---|
| DE | 3506381 | 8/1986 |
| EP | 0006707 | 1/1980 |
| EP | 0145410 | 6/1985 |
| EP | 563850 | 10/1993 |
| GB | 2130877 | 6/1984 |
| GB | 2172197 | 9/1986 |
| WO | WO 90/13239 | 11/1990 |

OTHER PUBLICATIONS

OEI, Value Added Furniture & Office Systems Serving Correctional Industries Brochure, undated.

* cited by examiner

FIG. 13
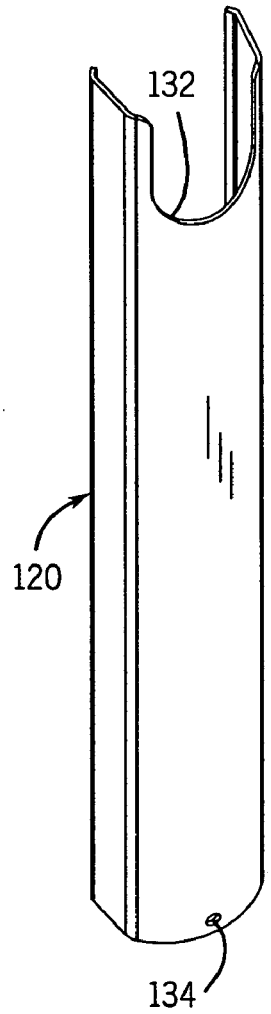
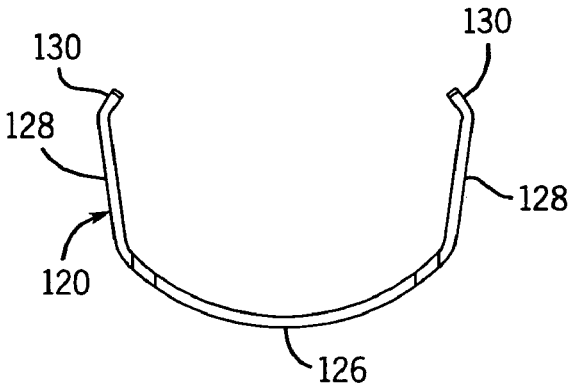
FIG. 15
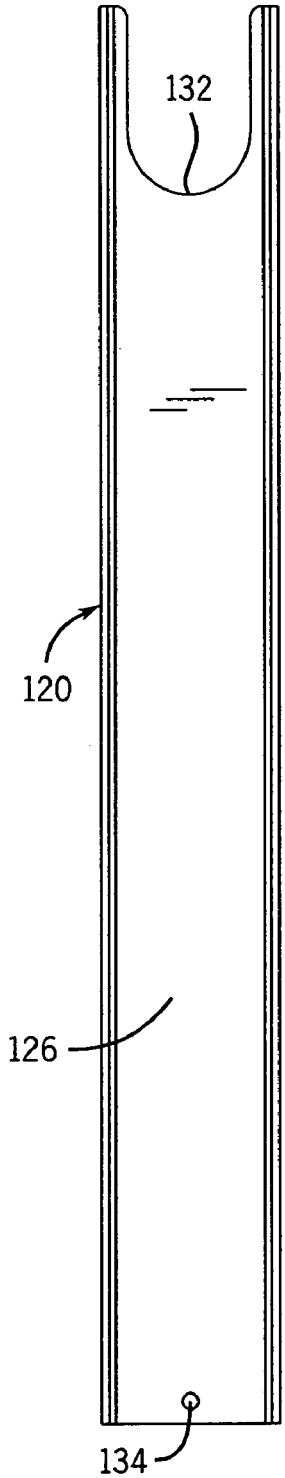
FIG. 14

WORKSURFACE SUPPORT SYSTEM WITH POWER AND COMMUNICATION CAPABILITY AND FRONT AND REAR ACCESS COVERS

CROSS-REFERENCE TO RELATED APPLICATION

This application claims the benefit of U.S. Provisional Application Ser. No. 60/353,696, filed Feb. 1, 2002.

BACKGROUND AND SUMMARY OF THE INVENTION

This invention relates to a desk or table, and more particularly to improvements in connection with providing power and/or communication capability for a desk or table and an adjustable height support assembly for use with a desk or table.

In accordance with a first aspect of the present invention, a desk or table unit includes a worksurface and leg structure that supports the worksurface above a supporting surface such as a floor. The worksurface defines a front and a rear. A wire management arrangement is located below the worksurface, and may be configured to extend between opposite sides defined by the worksurface. The wire management arrangement includes at least one wire support member and first and second covers, each of which is movable between an open position and a closed position. The first access cover is configured to provide access to the wire management member from the rear of the worksurface when the first access cover is in the open position. The second access cover is configured to provide access to the wire management member from the front of the worksurface when the second access cover is in the open position. The wire management arrangement preferably includes a pair of wire management members, in the form of an upper wire management member and a lower wire management member. At least the lower wire management member is preferably configured to define an upwardly facing trough or channel, to provide lay-in capability for cables or wires to be supported by the lower wire management member. The upper wire management member is also preferably formed to define an upwardly facing channel or trough, as well as an upstanding mounting wall. With this construction, wires or cables can be supported by the upper wire management member in a lay-in manner, or components of a rigid wireway power distribution system can be secured to the mounting wall of the upper wire management member. The first and second access covers may be mounted to the lower wire management member for movement between the open and closed positions. The first access cover is preferably configured to engage the upper wire management member when the first access cover is in the closed position. The first access cover and the upper wire management member are preferably configured such that a portion of the upper wire management member, which may be the mounting wall of the upper wire management member, is exposed between the underside of the worksurface and the upper end of the first access cover. With this construction, power outlets or receptacles may be secured to the exposed portion of the upper wire management member, to provide outwardly facing power outlets or receptacles that can be accessed from the rear of the worksurface.

In accordance with another aspect of the invention, the leg structure of the table or desk unit includes provisions for routing cables or wires from the lower end of the leg structure to the upper end, preferably for supplying power or communication wiring to a wire management arrangement located below the worksurface of the table or desk unit. The leg structure includes a foot member adapted to engage a supporting surface such as a floor, and a leg member that is mounted to and extends upwardly from the foot member. A worksurface support member is secured to the upper end of the leg member, and the worksurface is mounted to the worksurface support member. A wire cover member or wireway is releasably engageable with the leg member, and defines an internal passage within which wiring is adapted to be received. The wire cover member may have a channel configuration, defining spaced apart edges that engage an exterior surface of the leg member. The wire cover member is releasably engaged with the leg member via a clip member secured to the leg member, which is preferably configured to releasably engage the spaced apart edges of the wire cover member. The foot member preferably defines an upwardly facing recess within which a lower end of the wire cover member is received. The wire management arrangement, which is located below the worksurface, preferably includes an opening within which an upper end of the wire cover member is received. With this construction, the internal passage of the wire cover member establishes communication with an internal area of the wire management arrangement, to enable wires to be routed upwardly into the internal area of the wire management arrangement from a location adjacent the foot member. The wire cover member includes an opening located toward one of its ends, and can be reversed such that the opening is located either adjacent the foot member or adjacent the wire management arrangement. When the opening is located adjacent the foot member, wires can be passed through the opening and the internal passage of the wire cover member and into the internal area of the wire management arrangement. When there is no need for passing wires from the foot member into the internal area of the wire management arrangement, the wire cover member is reversed such that the opening is located adjacent the wire management arrangement, to conceal the opening in the wire cover member. The recess in the foot member has a shape that corresponds to the cross section of the wire cover member, to provide a finished appearance to the leg structure at the joint between the foot member and the leg member.

In accordance with another aspect of the invention, an adjustable height support assembly is engaged with the leg structure of a table or desk unit, to adjust the height of the worksurface relative to a supporting surface such as a floor. The adjustable height support assembly includes an upper adjustment member, a lower adjustment member movably mounted to the upper adjustment member, and a support member such as a glide, which is secured to a lower end defined by the lower adjustment member. In one embodiment, the upper adjustment member is threadedly engaged within a receiver associated with the leg structure, which may be secured to a foot member associated with the leg structure. The lower adjustment member is engaged with the upper adjustment member via a threaded engagement arrangement, which enables the lower adjustment member to be moved inwardly and outwardly relative to the upper adjustment member upon rotation of the lower adjustment member. The upper adjustment member and the lower adjustment member include engagement structure which is operable to prevent rotation between the upper and lower adjustment members when the lower adjustment member is moved outwardly to a predetermined position relative to the upper adjustment member. The engagement structure may be in the form of an expanded section located toward an upper end of the lower adjustment member. The upper adjustment member may be in the form of a generally cylindrical sleeve defining an externally threaded outer wall and a lower wall having a threaded opening within which the lower adjustment member is engaged The expanded upper section of the lower adjustment member is engageable with the lower wall of the generally cylindrical sleeve when the lower adjustment member is moved outwardly to a predetermined position relative to the sleeve, to prevent rotation of the lower adjustment member relative to the upper adjustment member. Subsequent rotation of the lower adjustment member causes rotation of the upper adjustment member, to extend the upper adjustment member relative to the receiver. In this manner, the upper and lower adjustment members provide a dual telescoping arrangement to increase the range of height adjustment that can be attained within a relatively compact envelope occupied by the support assembly.

The various features of the invention may be utilized independently of each other, and each provides an advantage in the construction, assembly and operation of a table or desk unit. The features of the invention can also be used altogether or in various combinations, to provide a significant enhancement in the construction, assembly and operation of the table or desk unit.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 13 is an isometric view of a wire cover or wireway incorporated into the leg assembly of FIGS. 10–12;

FIG. 14 is an elevation view of the wire cover or wireway of FIG. 13;

FIG. 15 is an end view of the wire cover or wireway of FIGS. 13 and 14;

DETAILED DESCRIPTION OF THE INVENTION

Figure 1:
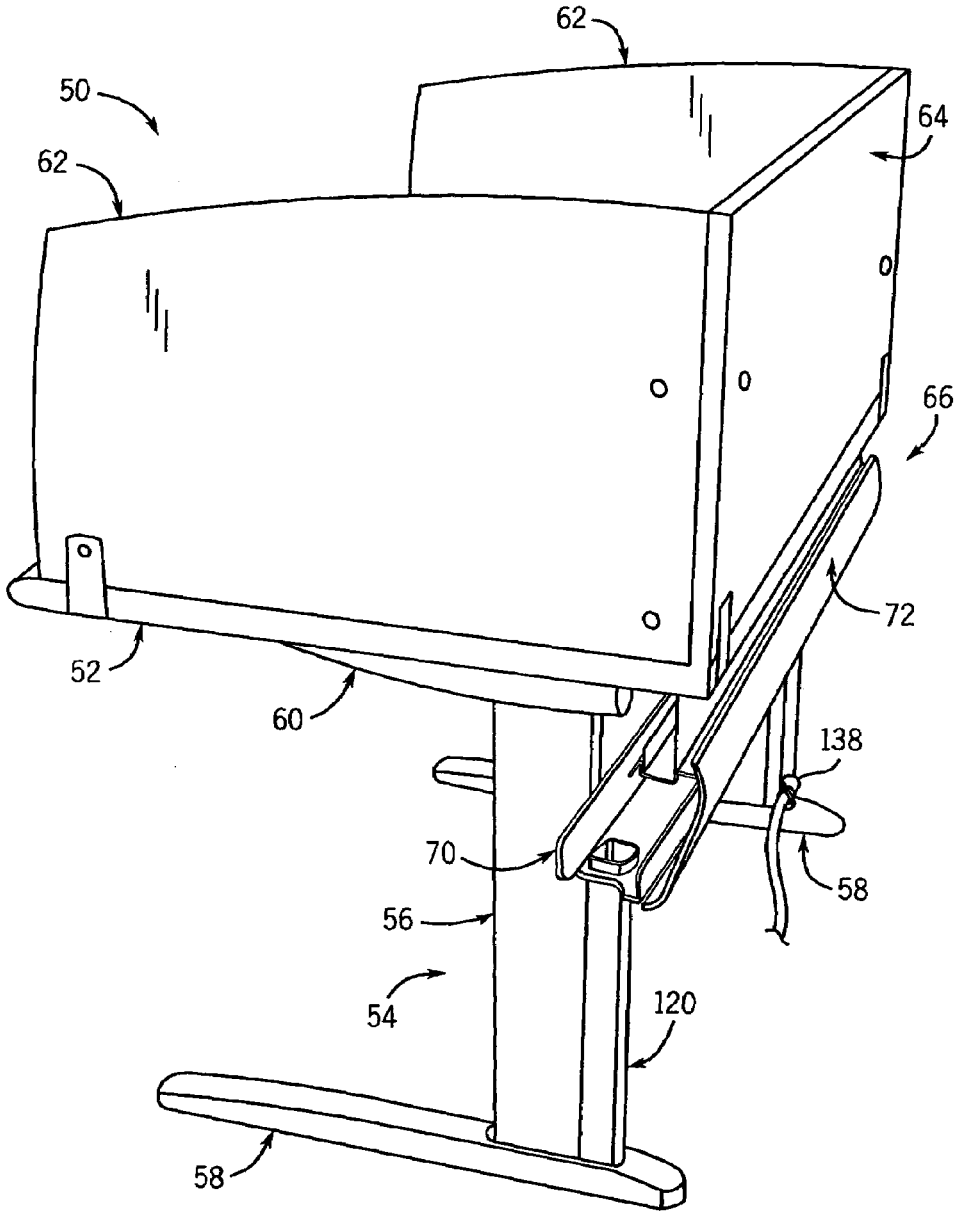
FIG. 1 is an isometric view of a desk unit incorporating the features of the present invention, showing the rear access cover in a closed position.
Figure 2:
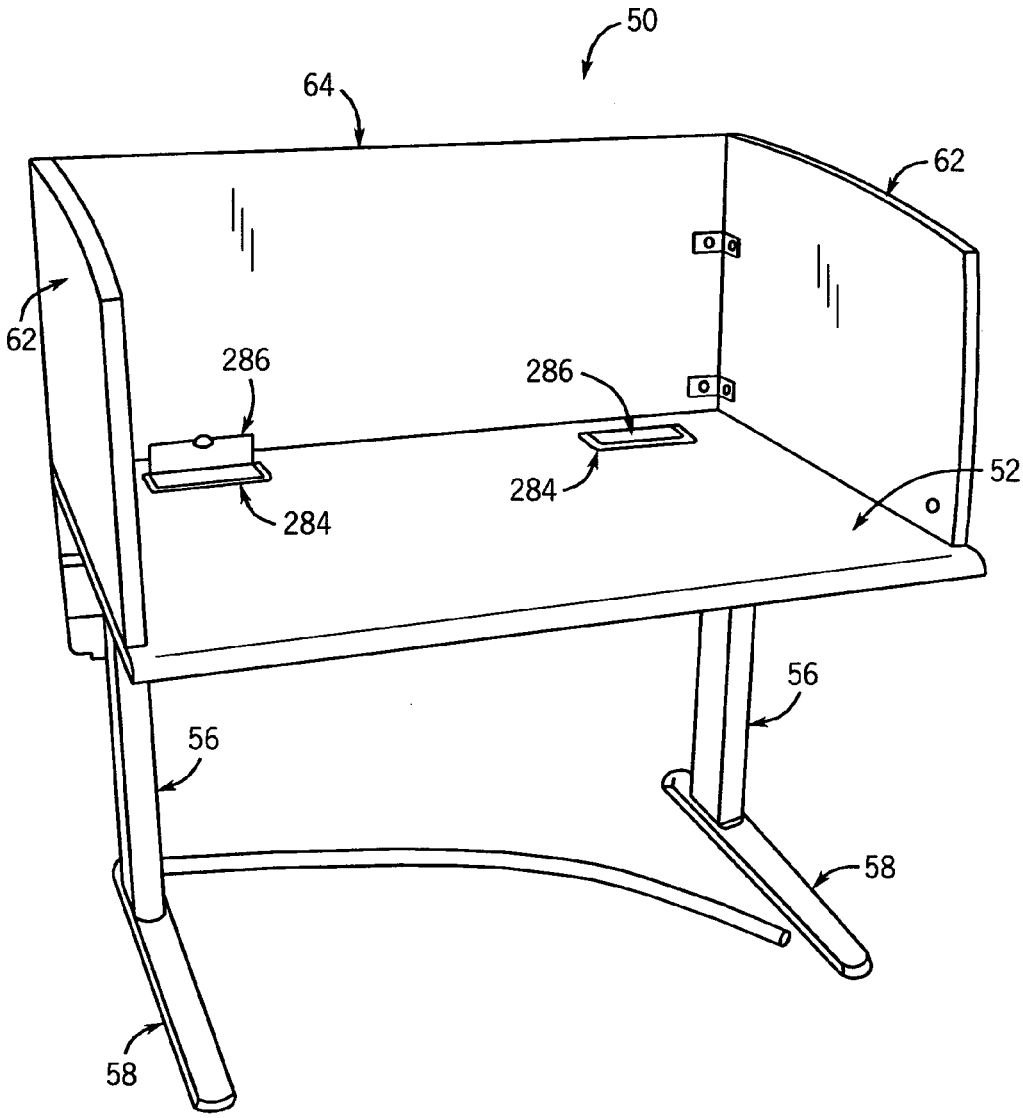
FIG. 2 is a front isometric view of the desk unit of FIG. 1.
Figure 3:
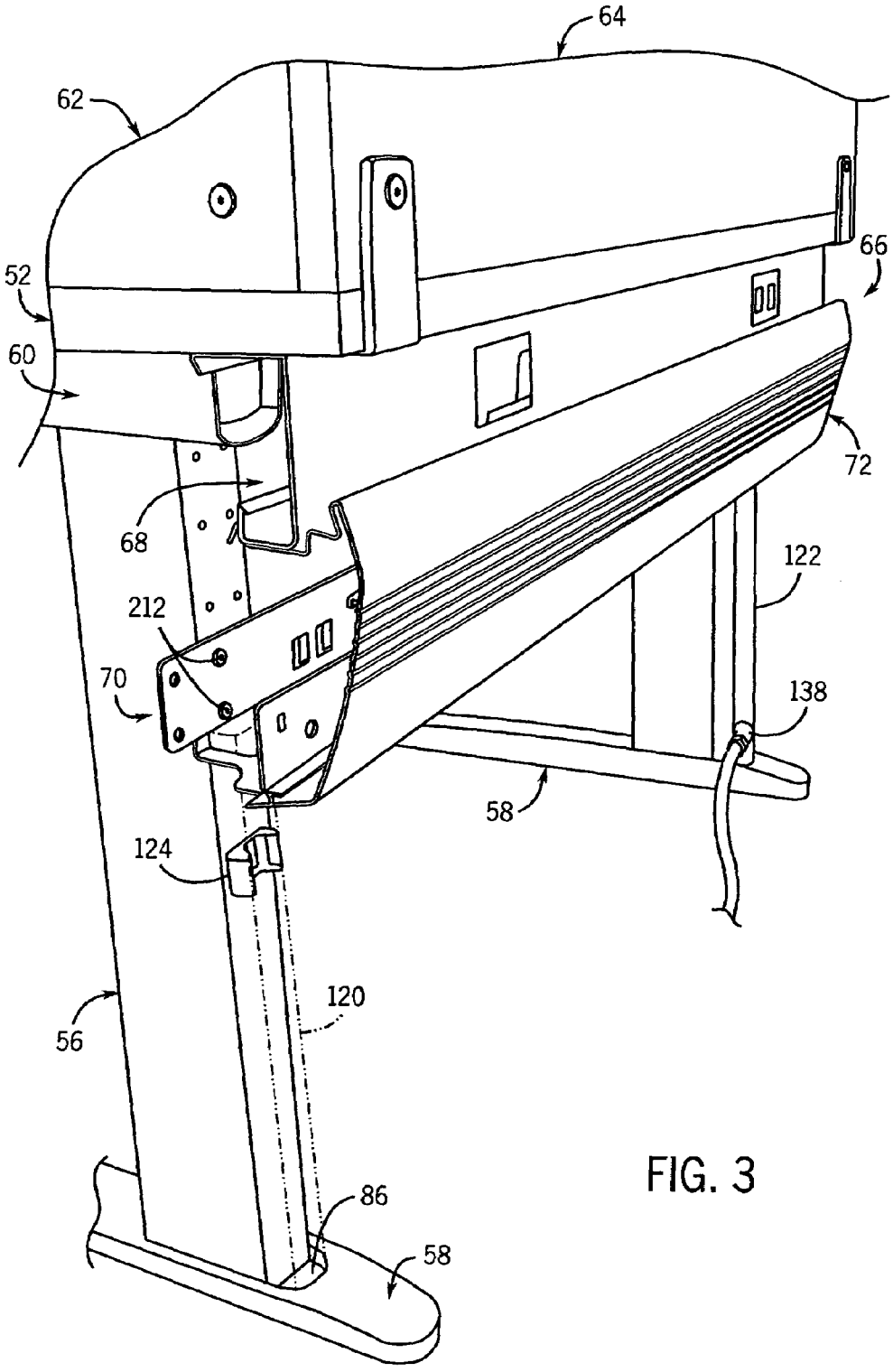
FIG. 3 is an enlarged partial isometric view of the desk unit of FIG. 1, showing the rear access cover and the upper and lower wire management members.

Referring to FIGS. 1–3, a table or desk unit 50 is adapted for use in either a stand-alone capacity or connected together with a series of additional table or desk units, such as in a classroom or training room environment. Table or desk unit 50 includes a worksurface 52 supported by a pair of leg assemblies 54, each of which generally includes a leg member 56, a foot 58 at the lower end of leg member 56, and an upper worksurface support member or cantilever 60 at the upper end of leg member 56. Screens or dividers 62, 64 may be mounted to the edges of worksurface 52, or may be omitted if desired.

Figure 4:
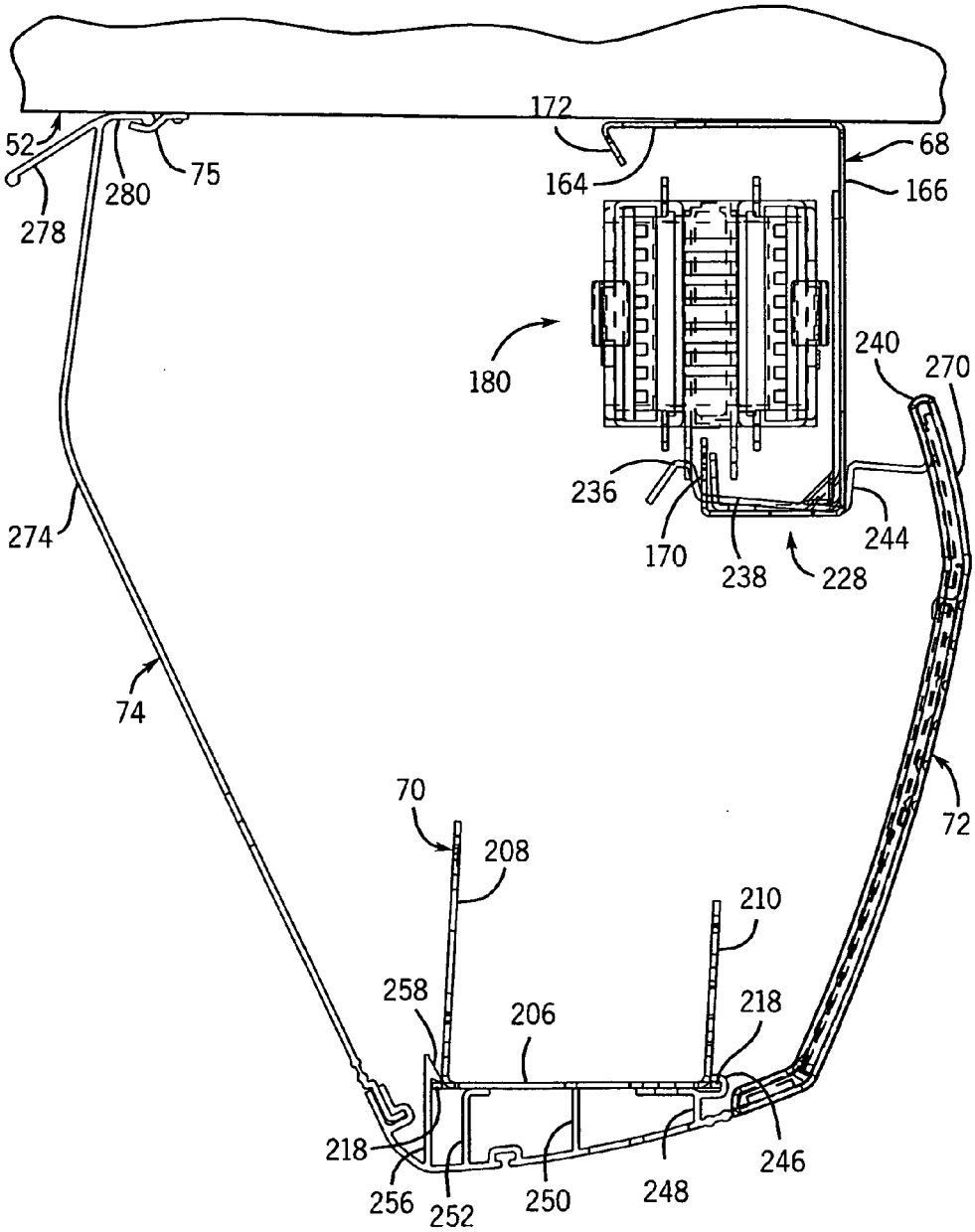
FIG. 4 is a cross-sectional view of the upper and lower wire management members and the front and rear access covers incorporated into the desk unit of FIG. 1, showing both the front and rear access covers in a closed position.
Figure 5:
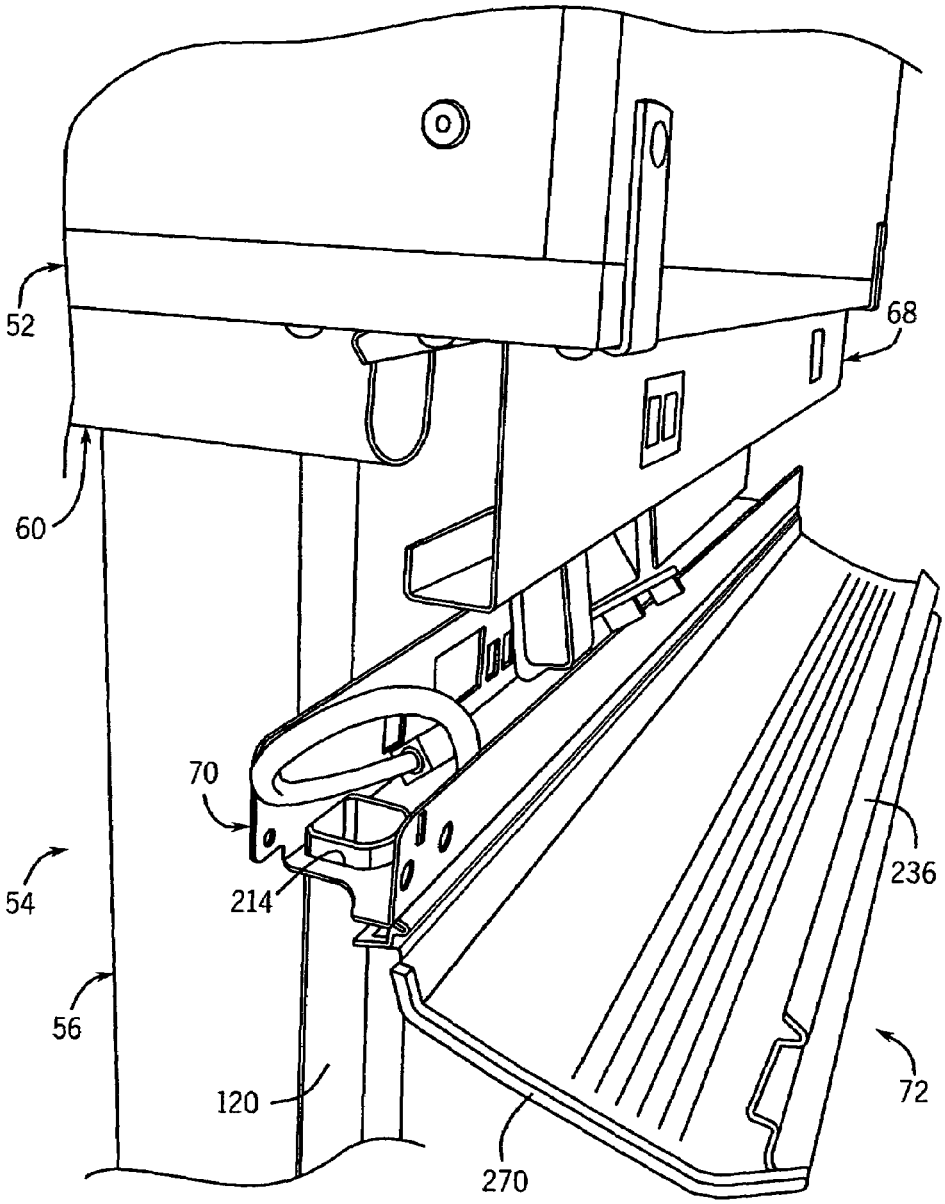
FIG. 5 is a view similar to FIG. 3, showing the rear access cover in an open position.
Figure 6:
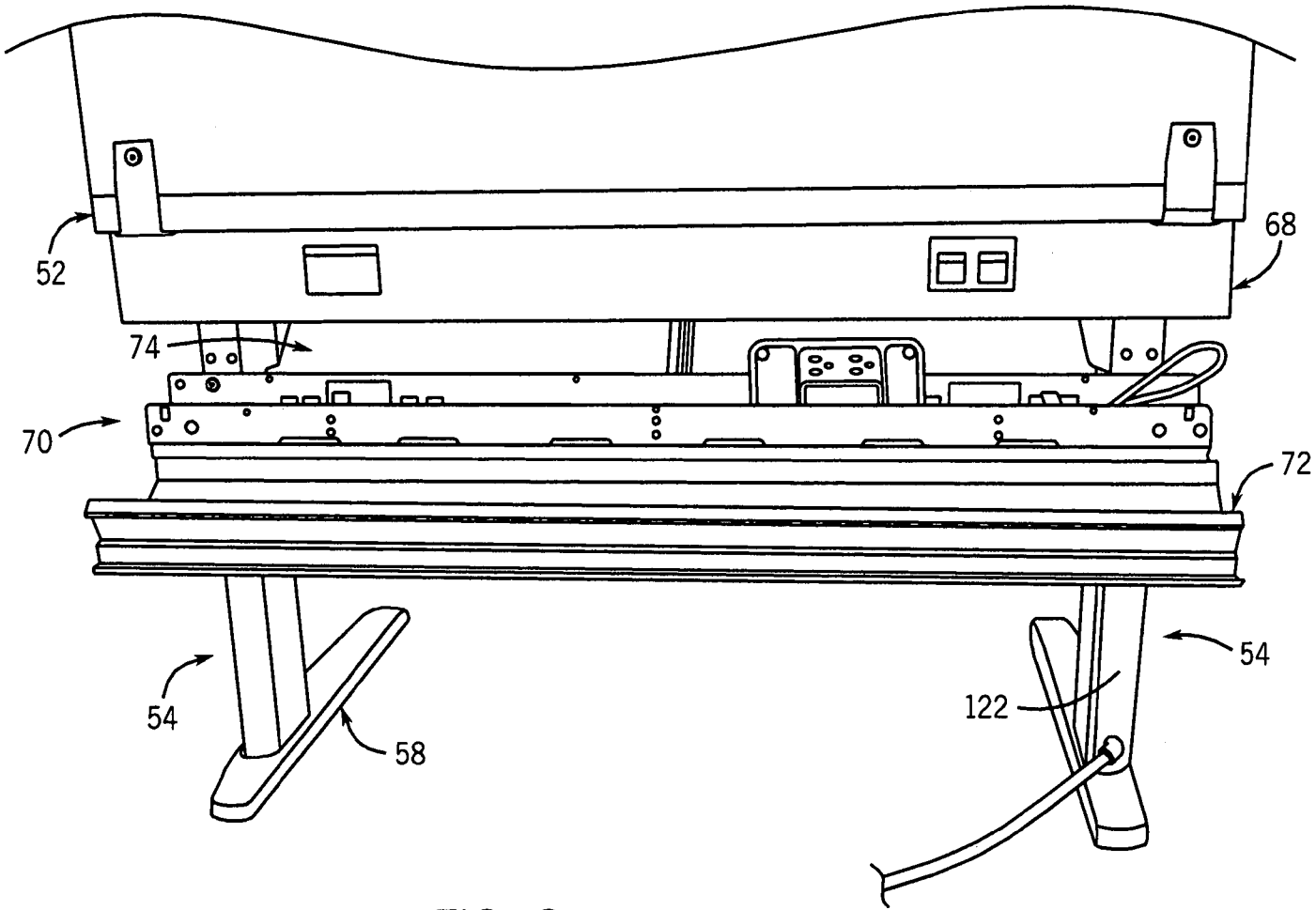
FIG. 6 is a rear isometric view of the desk unit of FIG. 1, again showing the rear access cover in an open position.
Figure 7:
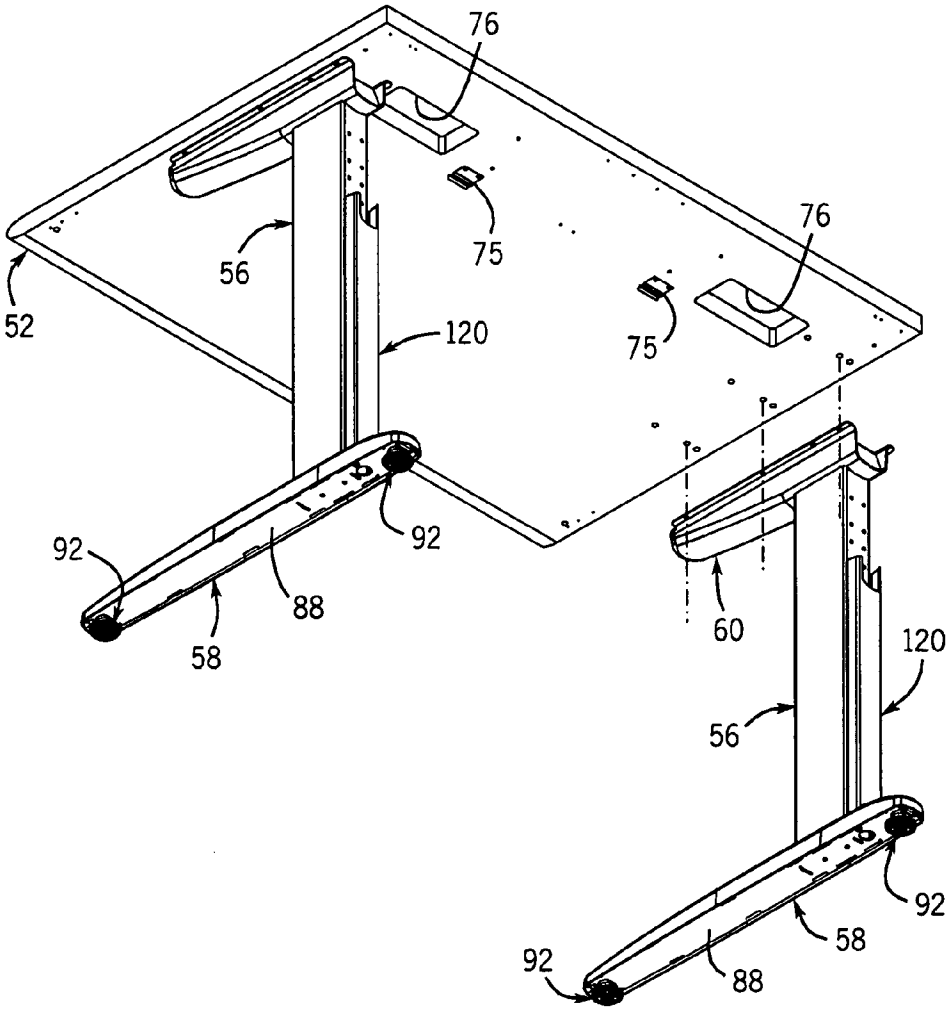
FIG. 7 is an exploded isometric view showing the underside of the desk unit of FIG. 1 and engagement of the legs with the underside of the desk unit.
Figure 8:
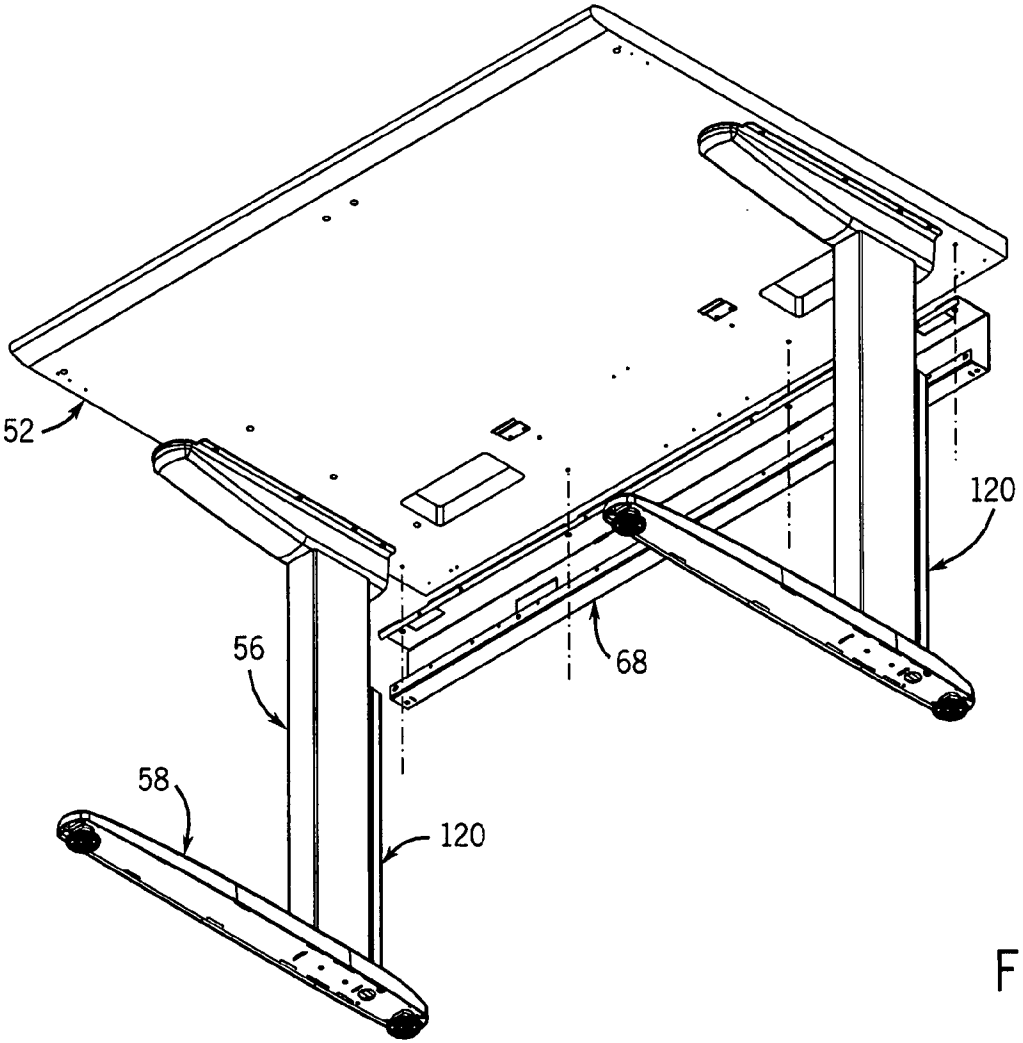
FIG. 8 is a view similar to FIG. 7, showing placement of the upper wire management member below the worksurface and between the legs of the desk unit.
Figure 9:
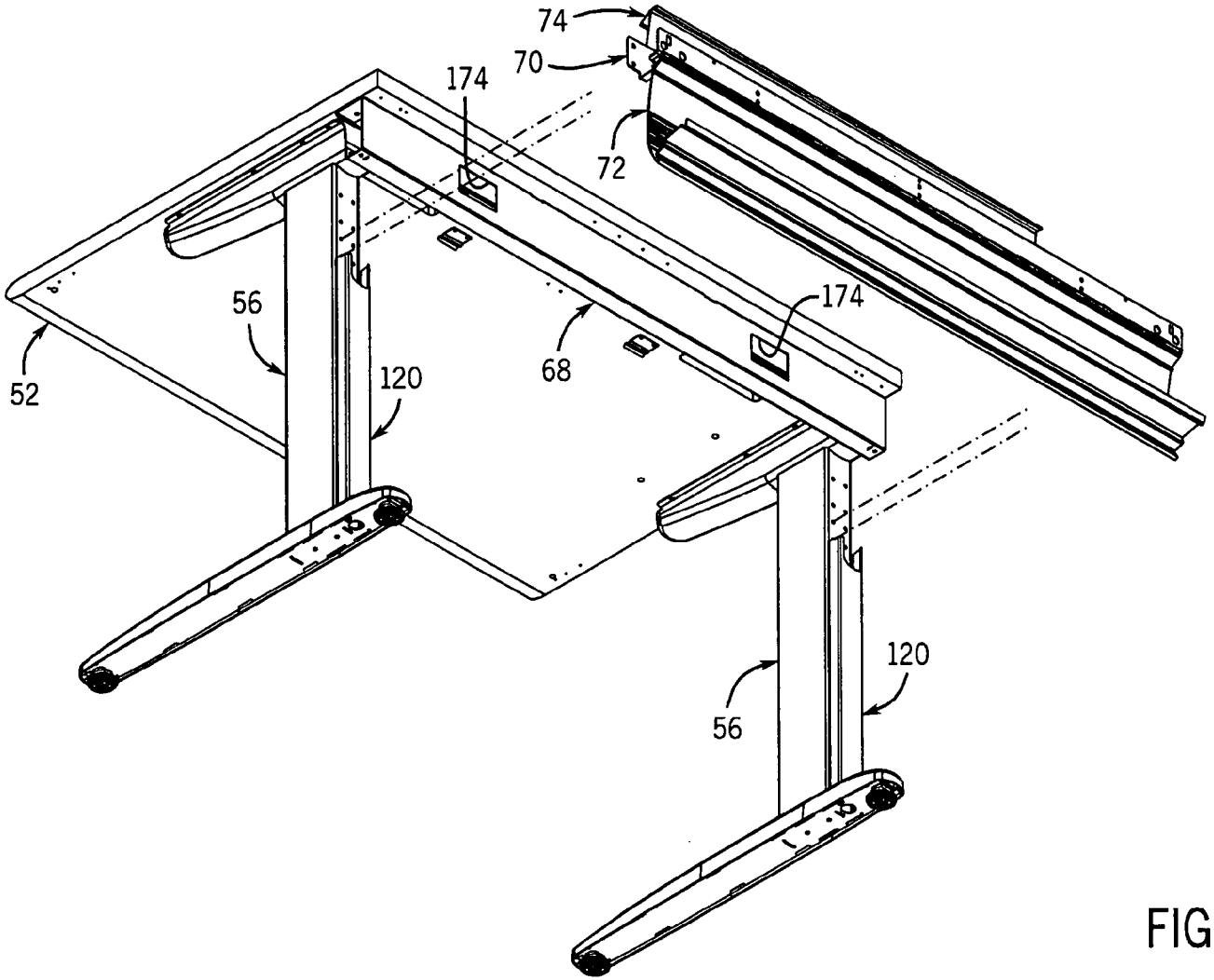
FIG. 9 is a view similar to FIGS. 7 and 8, showing placement of the lower wire management member and the rear access cover below the worksurface and between the legs of the desk unit.
Figure 10:
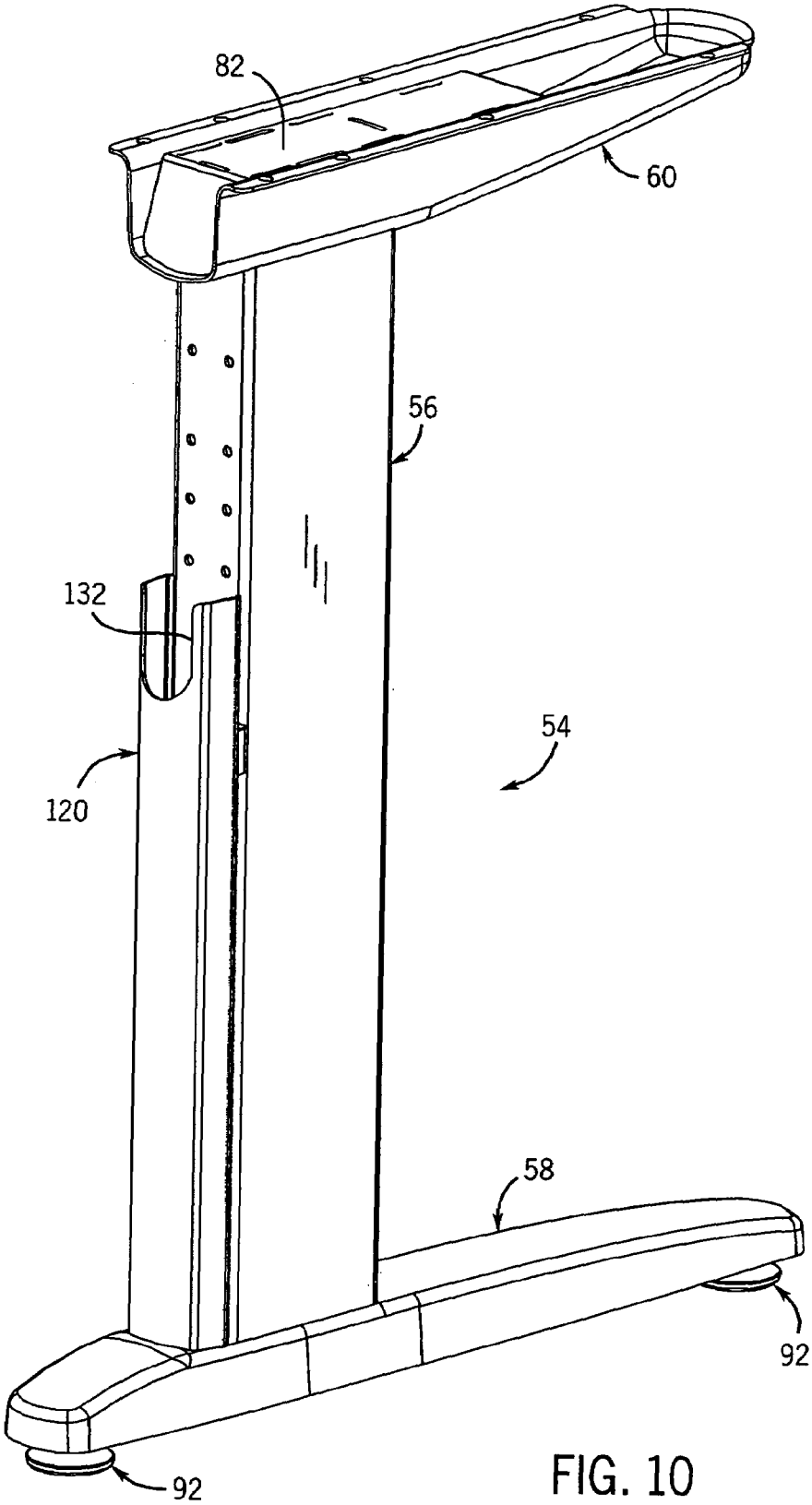
FIG. 10 is an isometric view showing a leg assembly incorporated into the desk unit of FIG. 1.

Table or desk unit 50 further includes a cable or wire management system 66 located below worksurface 52. Cable or wire management system 66 includes an upper wire management member 68 and a lower wire management member 70. A rear or outer access cover 72 is pivotably mounted to lower wire management member 70 and is selectively engageable with upper wire management member 68, for selectively providing access to lower wire management member 70 from the rear of table or desk unit 50. As shown in FIG. 4, a front or inner access cover 74 is pivotably mounted to lower wire management member 70 and is selectively engageable with the underside of worksurface 52 via a retainer catch or clip 75, for selectively providing access to upper wire management member 68 and lower wire management member 70 from the front of table or desk unit 50.

Worksurface 52 may have any size and shape as desired, and may be configured according to user specifications. In a representative configuration as shown in FIGS. 1–10, worksurface 52 may be in the form of a generally rectangular member and each leg assembly 54 is adapted for mounting to the underside of worksurface 52 in a conventional manner. Each leg assembly 54 is located toward one of the side edges of worksurface 52 and rearwardly of the longitudinal centerline of worksurface 52. Openings, such as shown at 76, are formed in the rearward area of worksurface 52, for enabling wires or cables to pass through worksurface 52.

The components and construction of each leg assembly 54 are shown in FIGS. 10–14. Each leg assembly 54 includes leg member 56, which may be in the form of a generally vertical tubular member, in combination with upper cantilever 60 welded to the upper end of leg member 56 and lower foot 58 welded to the lower end of leg member 56. Upper cantilever 60 includes a shoulder member 78 defining an opening 80 through which the upper end of leg member 56 extends, and an insert 82 located within a channel defined by shoulder member 78. Similarly, foot 58 includes a foot member 84 defining an opening 86 through which the lower end of leg member 56 extends. A foot insert 88 is mounted within the open underside of foot member 84. A pair of receivers, in the form of weld nuts 90, are secured one to each end of foot insert 88, and each weld nut 90 is adapted to receive either a glide assembly 92 or a caster assembly 94 for engagement with a supporting surface, such as a floor.

Figure 18:
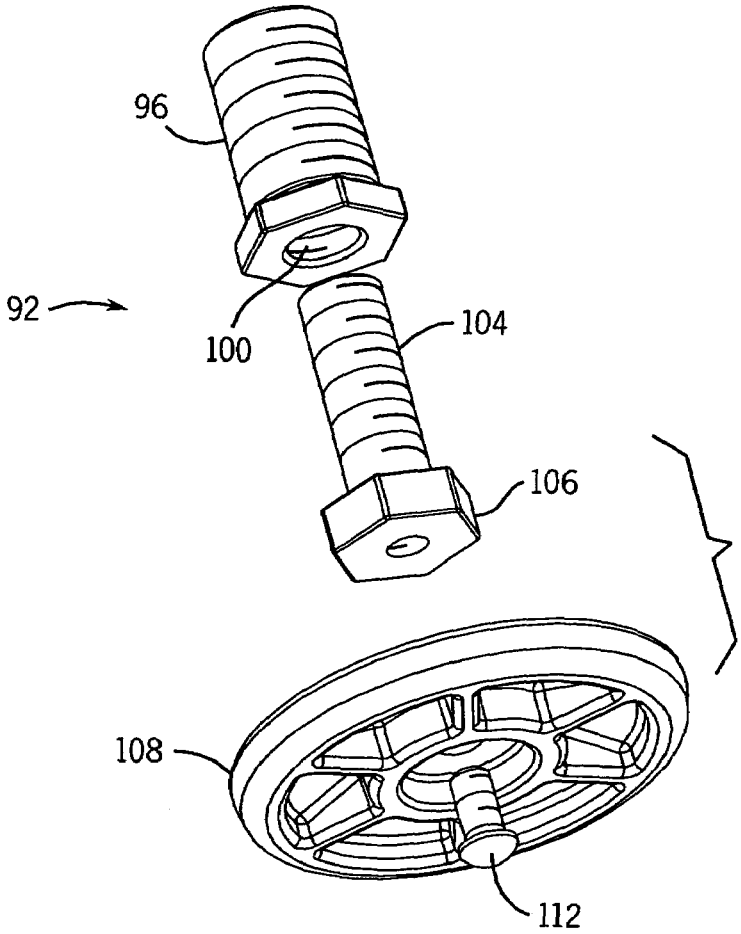
FIG. 18 is an exploded isometric view of a glide assembly incorporated into the leg assembly of FIGS. 10 and 11.
Figure 32:
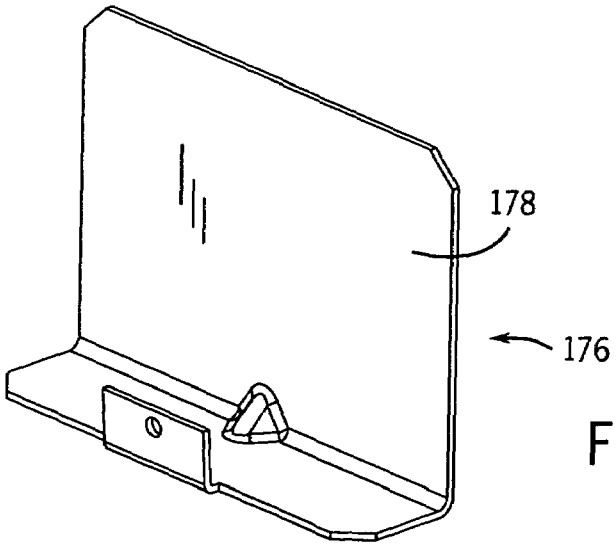
FIG. 32 is an isometric view showing a plate member adapted for engagement within one of the openings in the lower wire management members of FIG. 28.
Figure 19:
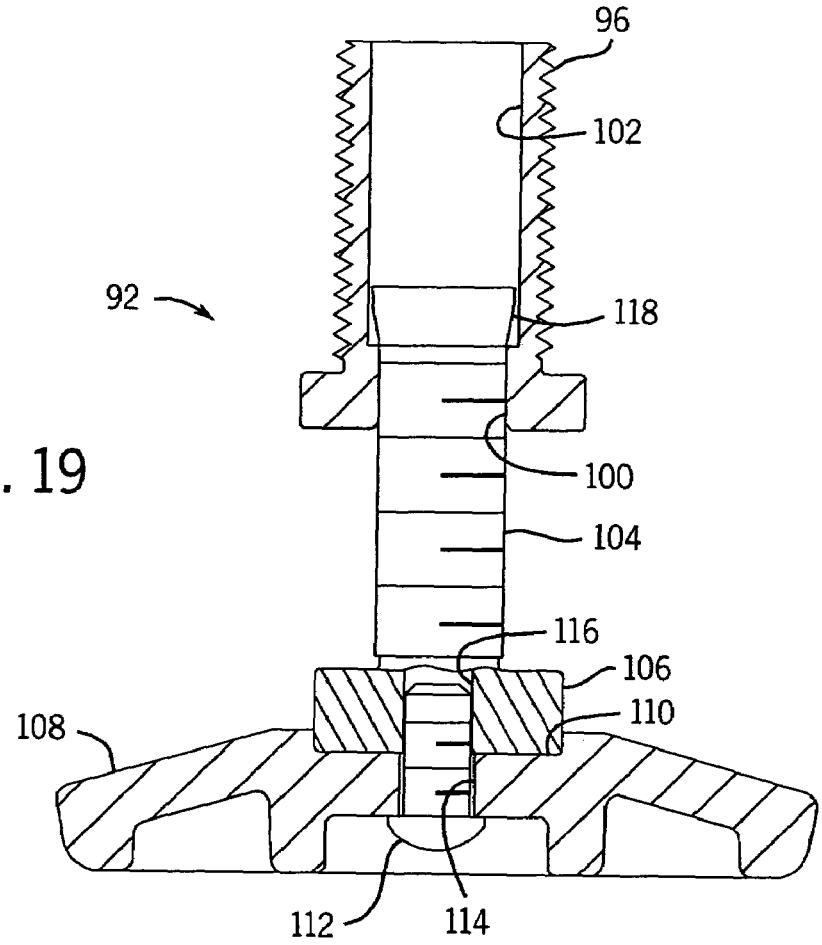
FIG. 19 is a longitudinal cross-sectional view of the assembled components of the glide assembly of FIG. 18, showing the glide assembly in an extended position.
Figure 20:
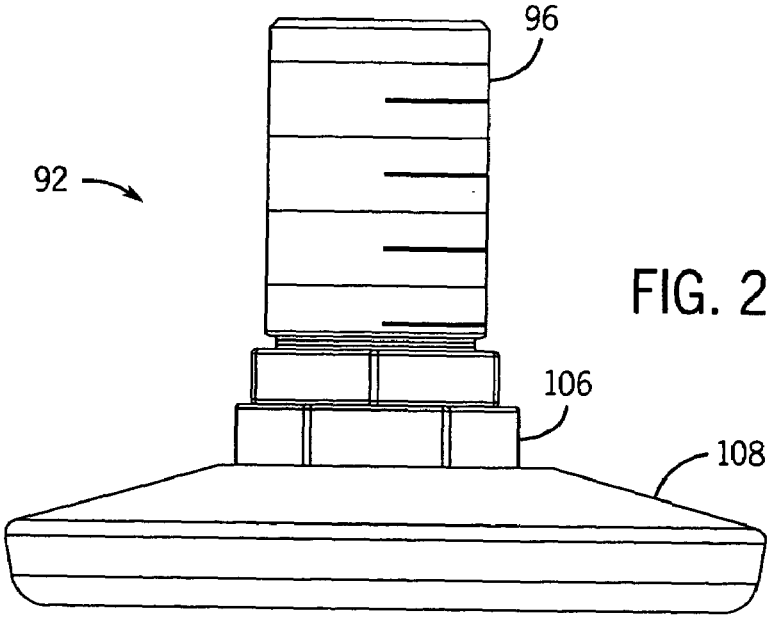
FIG. 20 is an elevation view of the glide assembly of FIGS. 18 and 19, showing the glide assembly in a retracted position.

The construction of glide assembly 92 is shown in FIGS. 18–20. In a manner to be explained, glide assembly 92 is constructed so as to provide a significant degree of vertical adjustment, to accommodate placement of table or desk unit 50 on an uneven floor. Glide assembly 92 includes an upper adjustment member or sleeve 96, which is a generally cylindrical member having an outer surface that includes external threads engageable with the threads of weld nuts 90. Upper adjustment member 96 further includes a hex head 98, and a threaded passage 100 which communicates with the open interior of upper adjustment member 96, shown at 102. A lower adjustment member, in the form of an extension member or bolt 104, defines external threads which engage the internal threads of threaded passage 100 defined by upper adjustment member 96. Extension member 104 includes a head 106 which is engaged with a glide base 108 having a recess 110 in its upper surface, which is configured so as to receive head 106 of extension member 104. A threaded fastener, such as a screw 112, extends through an opening 114 in glide base 108 and into an internally threaded passage 116 that extends upwardly through head 106 and into the shank of extension member 104. With this arrangement, screw 112 functions to securely engage glide base 108 with head 106 of extension member 104.

Upper adjustment member 96 and lower adjustment member 104 include engagement structure that functions to prevent rotation between upper adjustment member 96 and lower adjustment member 104 when lower adjustment member 104 is extended to a predetermined position relative to upper adjustment member 96. In the illustrated embodiment, the engagement structure is in the form of an expanded or outwardly flared section 118 located at the upper end of the shank of extension member 104. Expanded section 118 has a diameter greater than the diameter of threaded passage 100 in the end wall of upper adjustment member 96. In this manner, extension member 104 cannot be screwed out of upper receiver 96, and engagement of expanded section 1 18 with the inner surface of the end wall of upper adjustment member 96 adjacent opening 100 functions to cause upper adjustment member 96 and lower adjustment member 104 to rotate together upon application of a rotational force to lower adjustment member 104.

With the arrangement of glide assembly 92 as shown and described, a telescoping action of extension member 104 is obtained when glide base 108 is rotated so as to level table or desk unit 50, to level worksurface 52 relative to the support surface such as a floor. Initial adjustment is provided by rotating lower adjustment member 104 relative to upper adjustment member 96. When lower adjustment member 104 is in its fully extended position, outwardly flared area 118 engages the edge of passage 100 so as to prevent further outward movement of extension member 104 relative to upper receiver 96. Continued rotation of lower adjustment member 104 results in engagement of outwardly flared section 118 with the inner edge of opening 100, which causes upper adjustment member 96 to rotate within the threaded passage of weld nut 90. Such rotation of upper adjustment member 96 causes additional downward movement of glide base 108 relative to weld nut 90. In this manner, lower adjustment member 104 and upper adjustment member 96 provide a dual action telescoping glide assembly for providing a significant range of vertical adjustment capability in a compact envelope. When it is desired to retract glide assembly 92, the user rotates either upper adjustment member 96 or lower adjustment member 104. When upper adjustment member 96 is fully seated, lower adjustment member 104 is rotated to extend into the passage or upper adjustment member 96 to provide telescoping retraction of glide assembly 92. The user employs the noncircular engagement areas of upper adjustment member 96 and lower adjustment member 104 to facilitate rotation of each in order to adjust the height of worksurface 52.

Referring to FIGS. 10–17, opening 86 in foot member 84 has a depth greater than that of leg member 56. A vertical wire cover or wireway 120, or a base infeed cover 122, is adapted for engagement with leg member 56, and the lower end of vertical wire cover 120 or base infeed cover 122 is received within the portion of foot member opening 86 located rearwardly of leg member 56. In a preferred embodiment, vertical wire cover 120 or base infeed cover 122 is releasably engaged with leg 56 via a clip 124 located above floor member 86 and below wire management system 66. Clip 124 functions to releasably engage the upper end of vertical wireway 120 or base infeed cover 122, the lower end of which is received within the rearward area of foot member opening 86, such that vertical wireway 120 or base infeed cover 122 is releasably engaged with leg 56.

Figure 16:
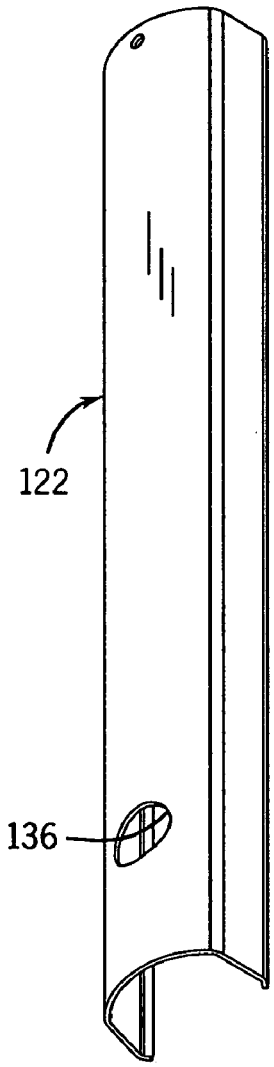
FIG. 16 is an isometric view of an alternative embodiment of a wire cover or wireway adapted to be incorporated into the leg assembly of FIGS. 10–12.
Figure 17:
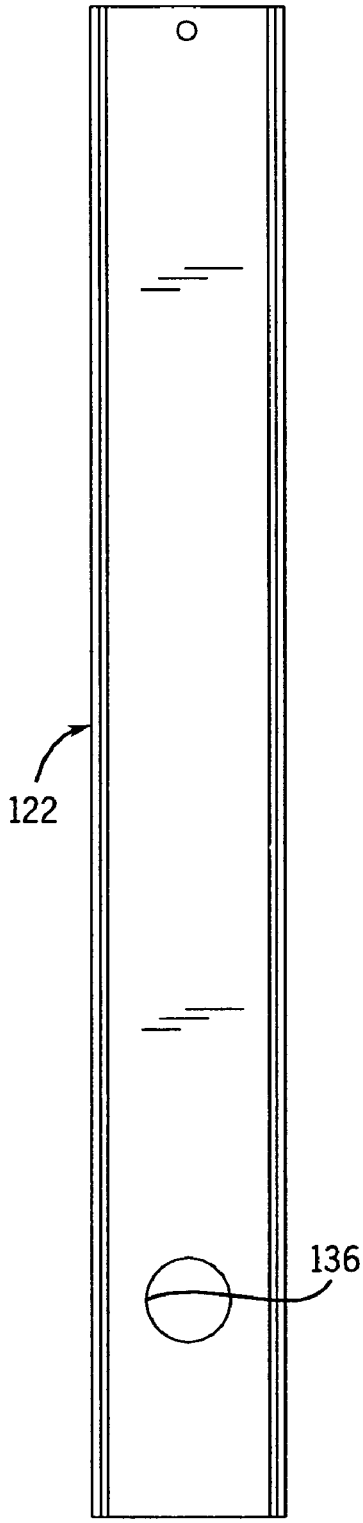
FIG. 17 is an elevation view of the wire cover or wireway of FIG. 16.

As shown in FIGS. 13–15, vertical wire cover 120 is in the form of a generally U-shaped channel member, including an outer wall 126 and a pair of side walls 128 having inwardly turned inner ends 130. Base infeed cover 122 is similarly configured, as shown in FIGS. 16 and 17. Vertical wire cover 120 includes a recess 132 in one of its ends, and an opening 134 in its opposite end. In a manner to be explained, the interior of vertical wire cover 120 defines a passage within which wires or cables are contained, and which are supported above vertical wire cover 120 by either upper wire management member 68 or lower wire management member 70. When vertical wire cover 120 is positioned such that recess 132 is at the lower end of leg member 56, recess 132 provides an exit area for such wires or cables from leg member 56. If desired, vertical wire cover 120 can be positioned with recess 132 either at the upper end or at the lower end of leg member 56. When wires or cables are not to be fed downwardly at leg member 56, vertical wireway 120 is positioned with recess 132 at the upper end of leg member 56, to conceal the presence of recess 132.

Base infeed cover 122 includes an opening 136 which is adapted to receive an elbow fitting 138 associated with a power infeed conduit 140.

Lower wire management member 70 includes a pair of spaced openings 214 located toward its ends. The upper end of the vertical wireway 120 or base infeed cover 122 of each leg assembly 54 is adapted to be received within one of the openings 214 in lower wire management member 70, such that the passage defined by the vertical wireway 120 or base infeed cover 122 is accessible from above lower wire management member 70. In the event vertical wireway 120 is positioned such that its recess 132 is located at the upper end of wireway 20, lower wire management member 70 and outer access cover 72 are operable to visually conceal the presence of recess 132 so as to provide a finished external appearance for the rearward area of leg assembly 54.

Figure 11:
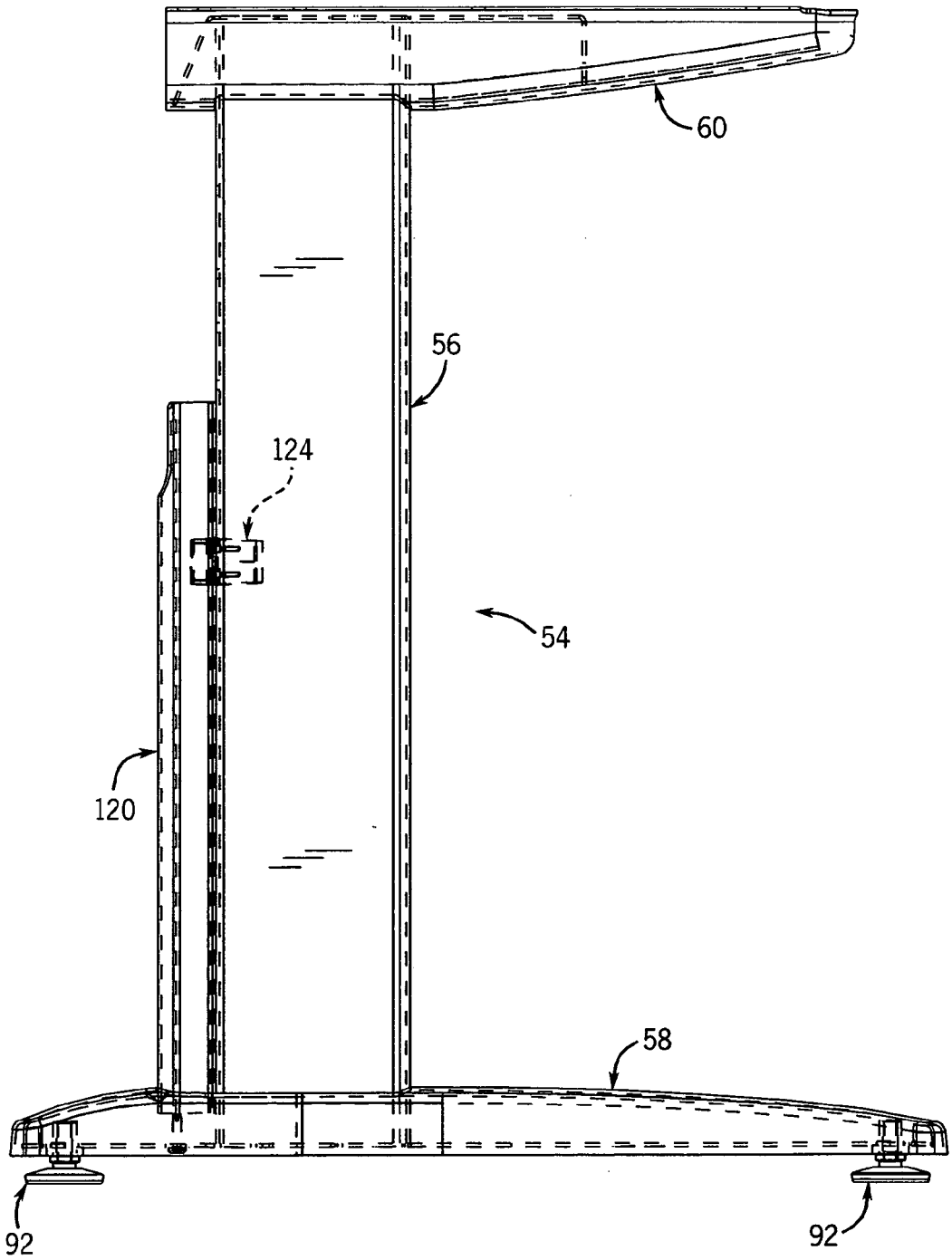
FIG. 11 is a side elevation view of the leg assembly of FIG. 10.
Figure 12:
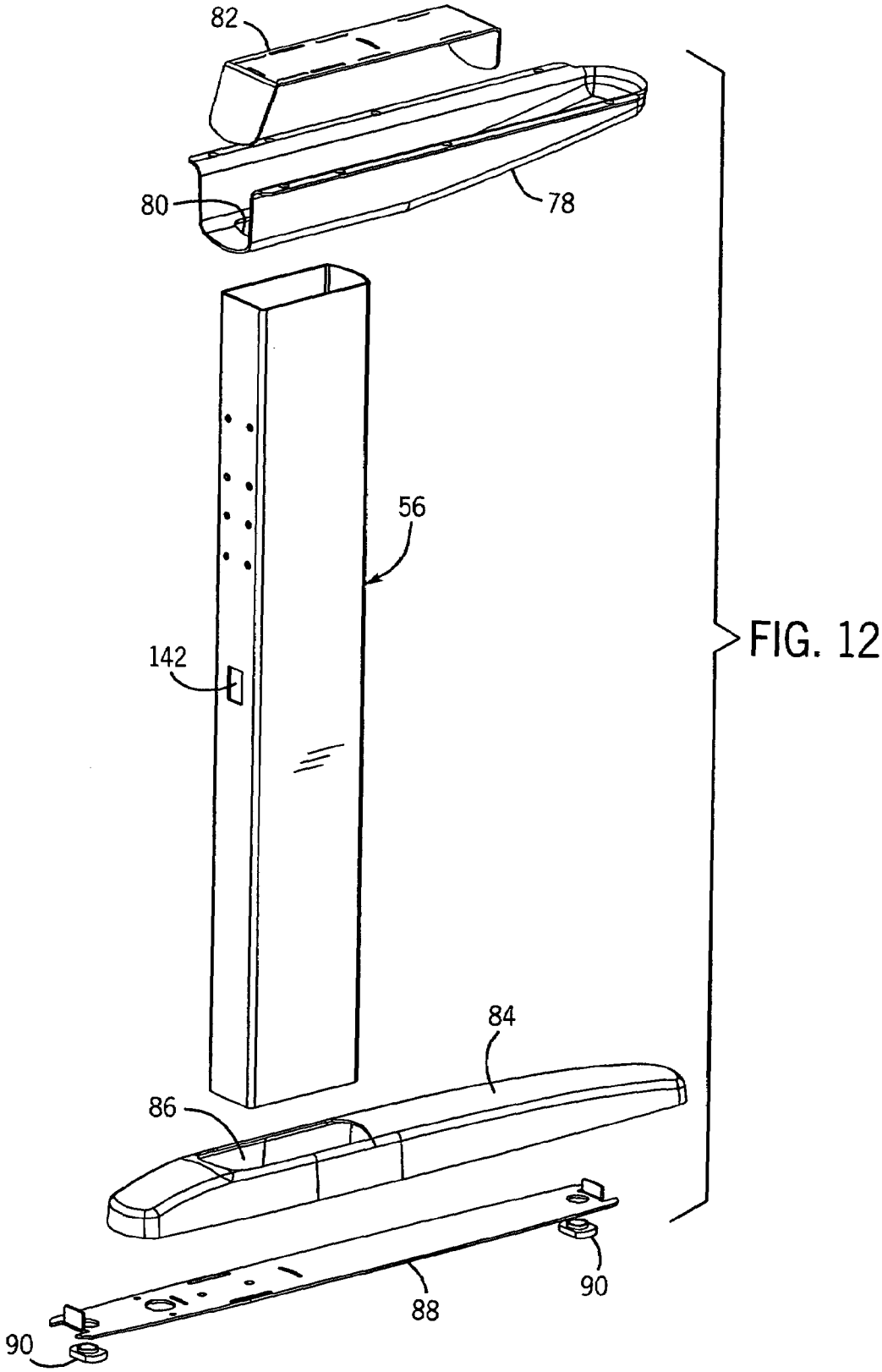
FIG. 12 is an exploded isometric view of the components of the leg assembly of FIGS. 10 and 11.
Figure 22:
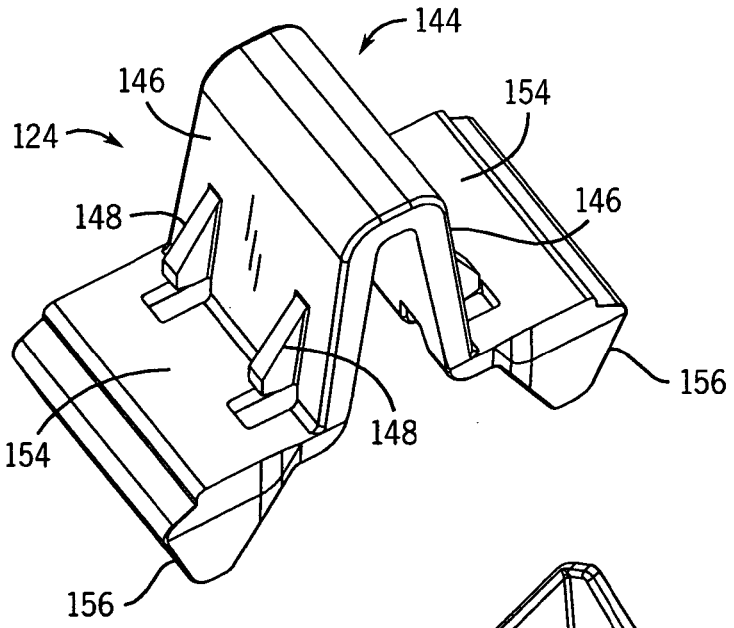
FIG. 22 is a reverse isometric view of the clip of FIG. 21.
Figure 21:
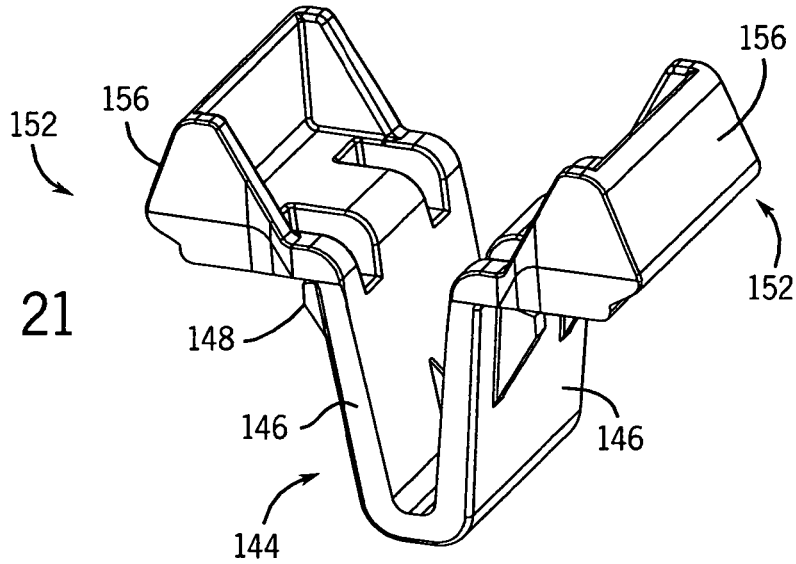
FIG. 21 is an isometric view of a clip incorporated into the leg assembly of FIGS. 10 and 11 for retaining the wire cover or wireway of FIGS. 13–17 in position on the leg assembly.
Figure 23:
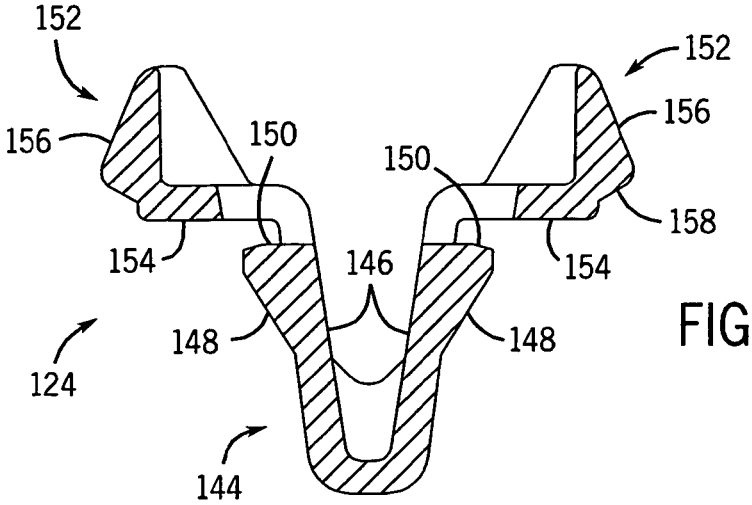
FIG. 23 is a cross-sectional view of the clip of FIGS. 22 and 23.
Figure 24:
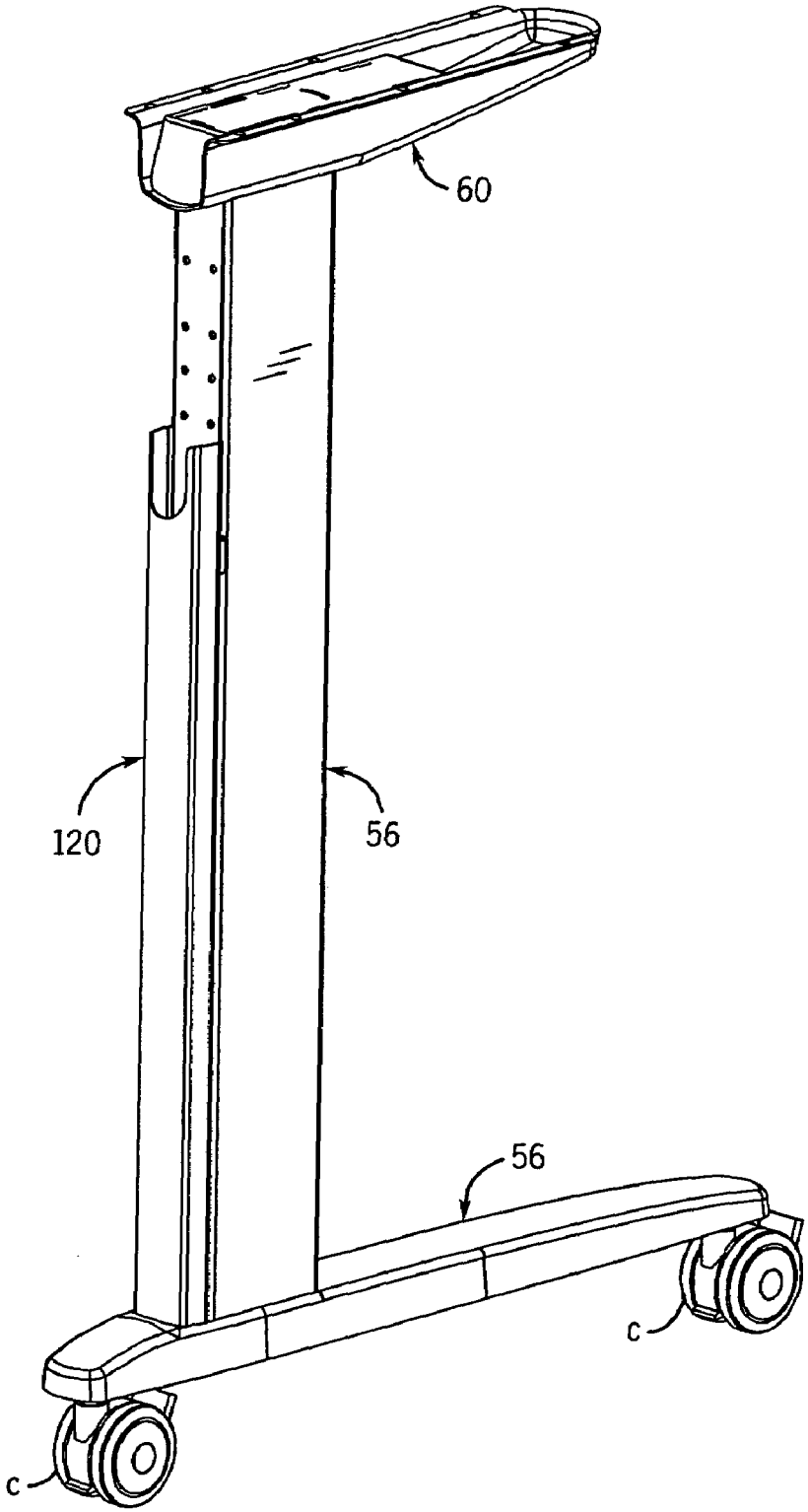
FIG. 24 is an isometric view similar to FIG. 10 showing an alternative embodiment for a leg assembly incorporated into the desk unit of the present invention.

Referring to FIGS. 11 and 12, clip 124 is adapted for engagement within a rectangular opening 142 formed in the rear wall of leg member 56. Vertical wire cover 120 or base infeed cover 122 is adapted to be releasably engaged with clip 124, for releasably retaining its upper end in place. As shown in FIGS. 21–23, clip 132 includes a generally V-shaped base section 144 defined by a pair of legs 146, each of which has a pair of outwardly extending wings 148 which terminate in an upper surface 150. A retainer section 152 extends outwardly from the upper end of each leg 146. Each retainer section 152 includes a transverse base wall 154 spaced above the upper surfaces 150 of wings 148, and an angled ramp wall 156 extending upwardly from the outer end of base wall 154. Ramp walls 156 define outer surfaces that converge toward each other, and retainer notches 158 are formed by the lower end of each ramp wall 156 in combination with the outer end of its associated base wall 154. Reinforcing end walls 160 extend upwardly from the ends of each base wall 154 and inwardly from the ends of each ramp wall 156.

In operation, clip 124 functions as follows to releasably engage the upper end of vertical wire cover 120 or base infeed cover 122 in engagement with leg member 56. First, clip 124 is secured to leg member 56 by engaging clip 124 within leg member opening 142 by inserting base section 144 into opening 142 with a push-on motion. As base section 144 is inserted into opening 142, wings 148 engage the facing edges of opening 142, which causes legs 146 to deflect inwardly toward each other. The user is able to apply manual pressure to ramp walls 156 to pinch the upper ends of legs 146 together, to accommodate such inward movement of legs 146. This inward deflection of legs 146 results in the outwardmost portions of wings 148 being moved inwardly an amount sufficient to enable wings 148 to pass through opening 142, such that the lower surfaces of transverse base walls 154 engage the wall of leg member 56 adjacent opening 142. The user then releases engagement with ramp walls 156, which results in outward movement of legs 146 under the influence of an outward bias provided by the connection of legs 146 together at the inner end of base section 144. The areas of the wall of leg member 56 adjacent opening 142 are received within the space between wing upper surfaces 150 and the facing lower surfaces of base walls 154, such that clip 124 is releasably mounted within opening 142.

When it is desired to engage the upper end of wire cover 120 or base infeed cover 122 with clip 124, the user first inserts the upper end of wire cover 120 or base infeed cover 122 into and through opening 214 in upper wire management member 70. Wire cover 120 or base infeed cover 122 is then moved upwardly an amount sufficient to place the lower end of wire cover 120 or base infeed cover 122 above the upper surface of foot member 58. The user then moves wire cover 120 or base infeed cover 122 toward leg member 56 such that the lower end of wire cover 120 or base infeed cover 122 is located over the rearward portion of recess 86 on the upper surface of foot member 58. This movement of wire cover 120 or base infeed cover 122 causes wire cover 120 or base infeed cover 122 to engage clip 124. During such movement of wire cover 120 or base infeed cover 122, inner ends 130 of side walls 128 engage clip ramp walls 156, and continued movement of wire cover 120 or base infeed cover 122 toward leg member 56 results in side wall ends 130 moving inwardly along ramp walls 156 so as to move clip legs 146 together, until side wall inner ends 130 clear the inner ends of ramp walls 156 and are received within retainer notches 158. Wing upper surfaces 150 are configured such that, during movement of legs 146 together in this manner, wing upper surfaces 150 remain in engagement with the leg member wall adjacent opening 142, to maintain clip 124 in engagement with leg member 56. When side wall inner ends 130 are received within retainer notches 158, the outward bias of clip legs 146 functions to move clip retainer sections 152 outwardly, to releasably secure the upper portion of wire cover 120 or base infeed cover 122 to leg member 56. The user then lowers wire cover 120 or base infeed cover 122 so that its lower end is inserted into and foot member opening 86 rearwardly of leg member 56, which maintains wire cover 120 or base infeed cover 122 in releasable engagement with leg member 56. When it is desired to remove wire cover 120 or base infeed cover 122, the user reverses the above steps and applies an outward force on the upper end of wire cover 120 or base infeed cover 122, which causes inner ends 130 of side walls 128 to move along the curved surfaces of notches 158 so as to move legs 146 inwardly toward each other until inner ends 130 clear notches 158. Side wall inner ends 130 then move outwardly along ramp walls 156, and the outward bias of the interconnected area of legs 146 functions to return base section 144 to its original condition, engaged within leg opening 142 as described above.

As noted previously, wire management system 66 includes upper wire management member 68, lower wire management member 70, outer access cover 72 and inner access cover 74. The details of construction of wire management system 66 are shown in FIGS. 4 and 25–37.

Figure 25:
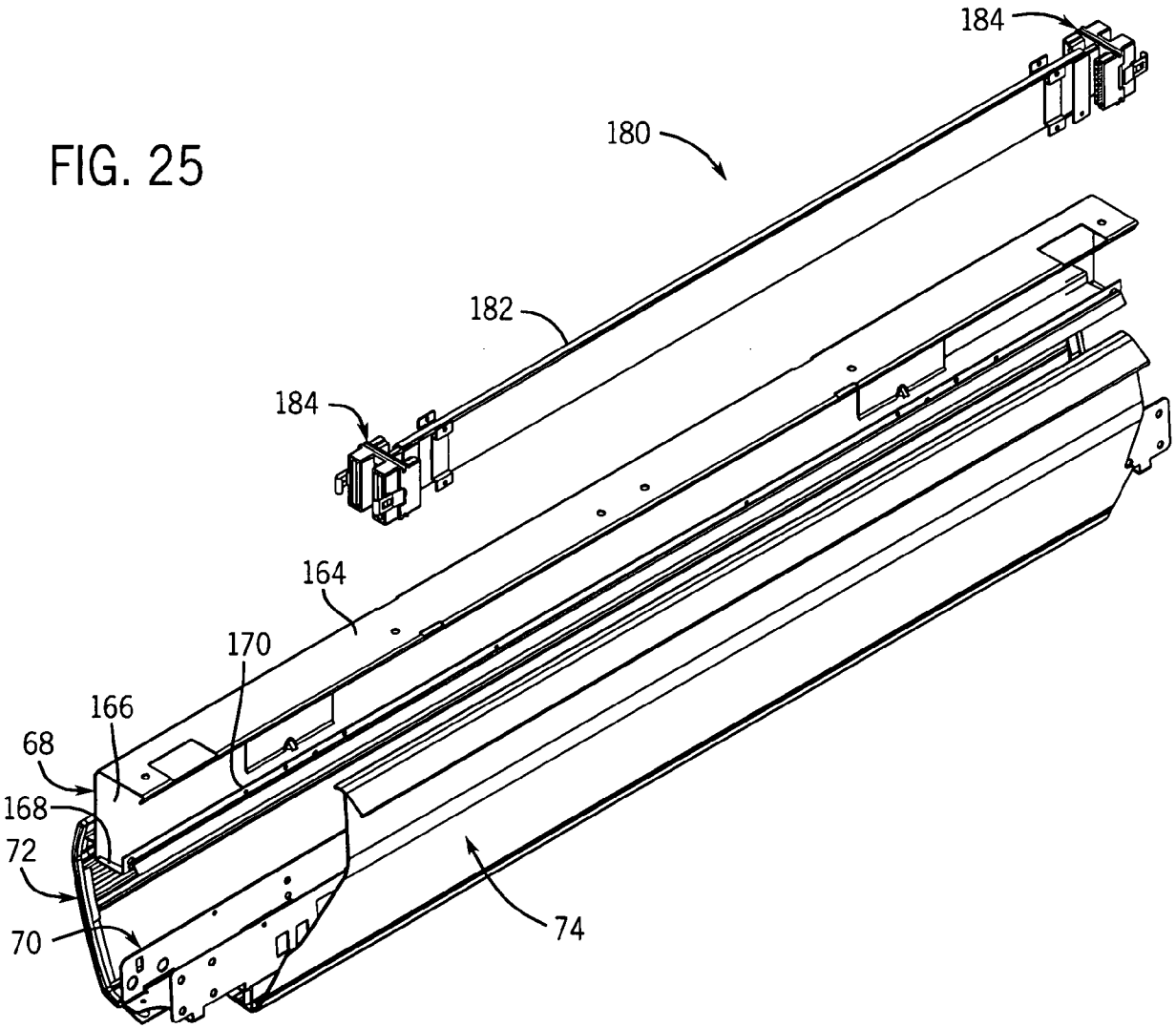
FIG. 25 is an isometric view, partially broken away, showing the upper and lower wire management members and the front and rear access covers incorporated into the desk unit of the present invention of the present invention as shown in FIG. 1, and illustrating one embodiment of a power distribution system incorporated into the desk unit.

Referring to FIGS. 4 and 25, upper wire management member 68 is in the form of a channel-shaped member including an upper flange 164, a web or mounting wall 166, a lower flange 168, and a lip 170 extending upwardly from the inner end of lower flange 168. An angled lip 172 extends downwardly from the inner end of upper flange 164, for imparting rigidity to upper flange 164. A series of spaced apart openings 174 are formed in web 166.

As shown, upper flange 164 is adapted for connection to the underside of worksurface 52 in any satisfactory manner, such as by threaded fasteners that extend through openings in upper flange 164 and into engagement with threaded receivers in the underside of worksurface 52. It is understood, however, that upper wire management member 68 may also be mounted to leg assemblies 54, such as to the rear of cantilevers 60 or to the rear surfaces of leg members 56. Any other satisfactory mounting arrangement may be provided for mounting upper wire management member 68 below worksurface 52.

Figure 26:
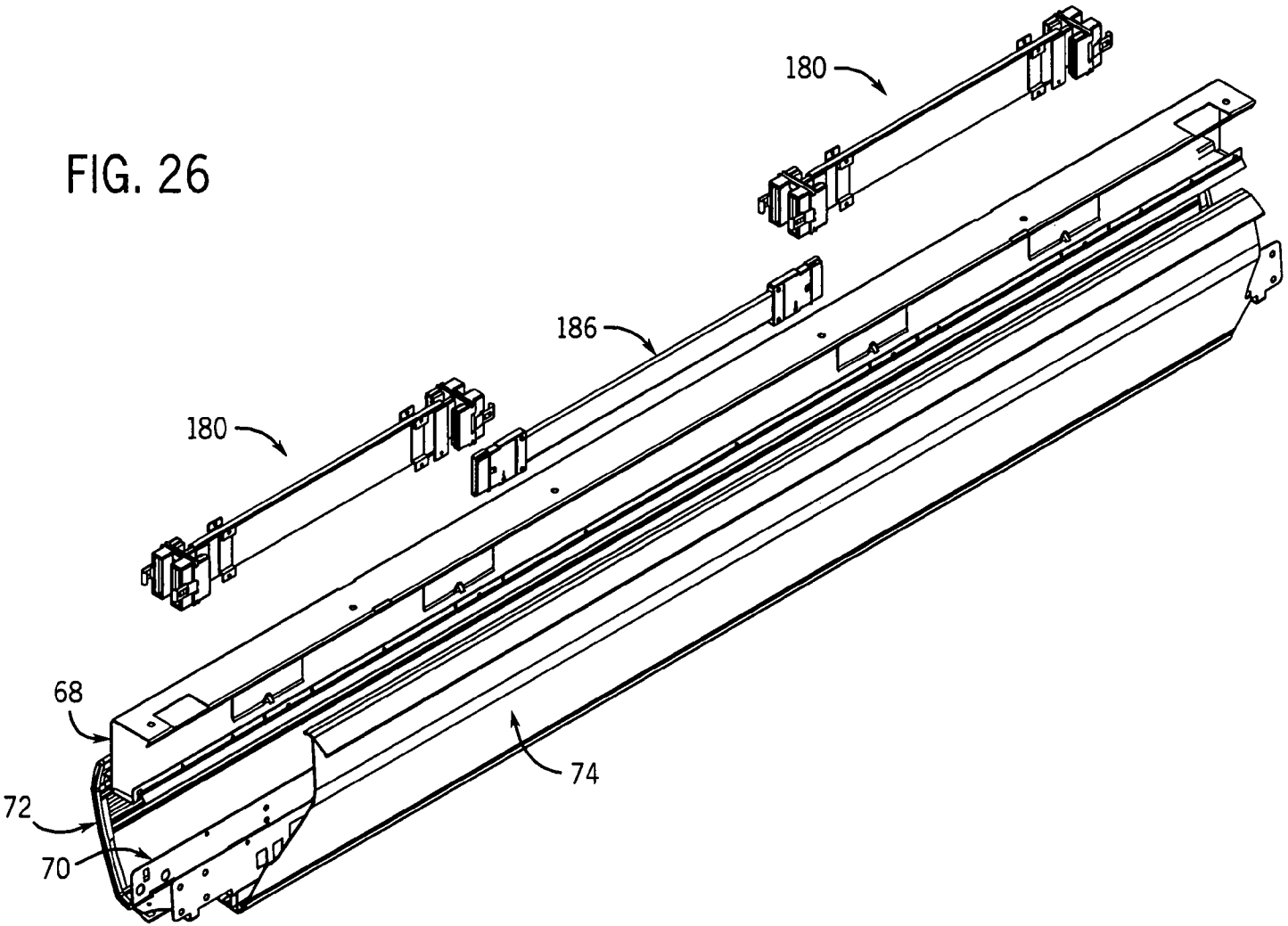
FIG. 26 is a view similar to FIG. 25, showing another embodiment of a power distribution system incorporated into the desk unit.

In a non-powered version of cable management system 66, cover members 176 (FIG. 31) are engaged within the openings 174 formed in mounting wall 166 of upper wire management member 68. Each cover member includes an upstanding section 178 that fills each opening 174. In a powered version as shown in FIG. 25, a rigid wireway assembly 180 is adapted to be supported by upper wire management member 68. In accordance with known construction, rigid wireway assembly 180 includes a conduit 182 having connector blocks 184 at its opposite ends. Alternatively, as shown in FIG. 26, a pair of rigid wireway assemblies 180 may be interconnected by a jumper 186, also in a manner as is known.

Each rigid wireway assembly 180 may be secured to upper wire management member 68 in any satisfactory manner, such as by means of mounting brackets and threaded fasteners, in a known manner. In the powered version, power outlet receptacles are engageable with connector blocks 184, and openings 174 in upper wire management member web 166 are positioned such that the power outlet receptacles are exposed through openings 174. Power is communicated between adjacent table or desk units 50 by engaging a jumper with connector blocks 184 of the adjacent table or desk units 50.

Figure 27:
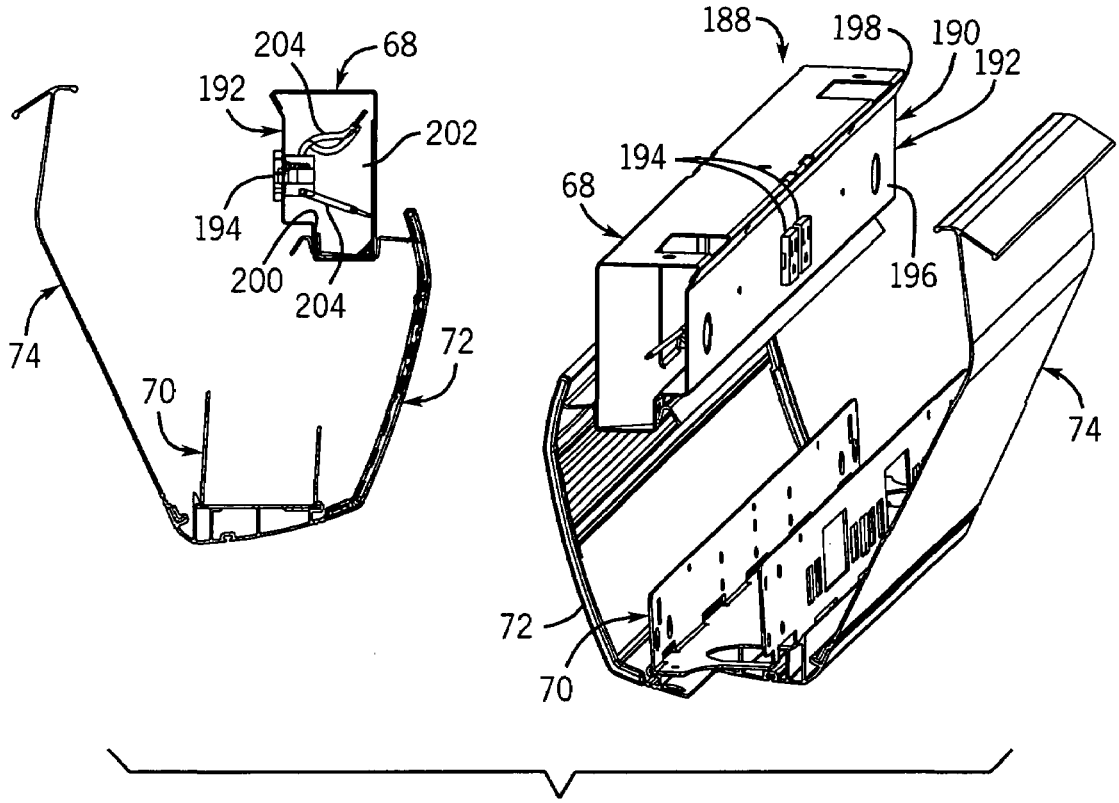
FIG. 27 is an isometric view showing another embodiment of a power distribution system adapted for incorporation into the desk unit of FIG. 1.

In yet another alternative version, upper wire management member 68 may form the basis for a hardwired power distribution system 188, as shown in FIG. 27. In this version, one or more face plate assemblies 190 are secured to the front of upper wire management member 68. Each face plate assembly 190 includes a cover 192 and a series of outlet receptacles 194 secured to cover 192. Cover 192 includes a front wall 196 to which outlet receptacles 194 are mounted, as well as an upper mounting flange 198 engageable with upper lip 172 and a lower mounting flange 200 engageable with lower lip 170. Cover 192 is adapted for securement to the front of upper wire management member 68 by means of threaded fasteners, such as screws, extending through aligned openings in upper flange 198 and upper lip 172, as well as in lower flange 200 and lower lip 172.

In this manner, face plate assembly 190 cooperates with upper wire management member 68 to define an internal passage 202 adapted to receive power distribution wires. The trough structure defined by web 166, lower flange 168 and lip 170 of upper wire management member 68 functions to support wiring located within internal passage 202. In a conventional manner, such power distribution wiring is interconnected with outlet receptacles 194 via connector wires 204 which extend from outlet receptacles 194, to distribute power along the length of upper wire management member 68. For adjacent table or desk units 50, such power distribution wiring extends between aligned internal passages 202 defined by the upper wire management members 68 and face plate assemblies 190 of adjacent table or desk units 50, to distribute power along the length of a series of table or desk units 50.

Referring to FIGS. 28–31, lower wire management member 70 is generally U-shaped in cross-section, and defines a channel trough-like structure. Lower wire management member 70 includes a bottom wall 206, a front wall 208 and a rear wall 210. Lower wire management member 70 is mounted below worksurface 52 in any satisfactory manner, such as by means of screws 212 that extend through openings in front wall 208 and into engagement with threaded openings formed in the rear wall of leg member 56. Alternatively, it is understood that lower wire management member 70 may be mounted in any other satisfactory manner to leg member 56 or to any other component of leg assembly 54, or may be mounted below upper wire management member 68 by connection to upper wire management member 68 independently of engagement with any component of leg assembly 54. In the illustrated embodiment, lower wire management member 70 provides the dual function of managing a set of wires or cables as well as providing structural reinforcement to and between leg assemblies 54.

As noted previously, bottom wall 206 of lower wire management member 70 includes an opening 214 located slightly inwardly of each end of lower wire management member 70, which is adapted to receive the upper end of vertical wire cover 120 or base infeed cover 122. In addition, bottom wall 206 defines a recess 216 which opens onto the end of lower wire management member 70, which is configured to cooperate with the recess 216 of a lower wire management member 70 associated with an adjacent table or desk unit 50 to form an opening shaped similarly to opening 214, for receiving the upper end of vertical wireway 120 or base infeed cover 122 of the adjacent table or desk unit 50. In this manner, lower wire management member 70 is normally positioned such that, at one end of lower wire management member 70, the upper end of a vertical wire cover 120 or base infeed cover 122 is positioned within opening 214. At the opposite end of the table or desk unit 50, the other opening 214 is unoccupied and the vertical wire cover 120 or base infeed cover 122 is received within the opening defined by cooperating recesses 216 of lower wire management members 70 of adjacent table or desk units 50.

A series of outwardly extending mounting tabs 218 extend outwardly from each end of bottom wall 206. Mounting tabs 218 are formed by cut out areas of front and rear walls 208, 210, respectively. Representatively, lower wire management member 70 may be formed of a section of bent sheet metal, and mounting tabs 218 may be stamped out of front and rear walls 208, 210, respectively, and formed in the bending operation.

Front wall 208 of lower wire management member 70 is formed with a series of relatively large rectangular openings 220 as well as smaller rectangular openings 222 and 224.

Lower wire management member 70 is normally adapted to support voice or data communication wires or cables, and openings 220, 222 and 224 are adapted to receive voice or data communication receptacles interconnected with the wires or cables of the voice or data communication system.

With the construction and arrangement of upper wire management member 68 and lower wire management member 70, the wiring associated with the power distribution system and the wiring associated with the communication distribution system are separate and isolated from each other. The open construction of both upper wire management member 68 and lower wire management member 70 provides lay-in wire capability, and also provides quick and easy access to the wiring or cabling for service, addition or removal of components, or any other operation which requires access to the power distribution or communication distribution components supported by upper wire management member 68 and lower wire management member 70.

Referring to FIGS. 4 and 33–35, outer access cover 72 and inner access cover 74 may be interconnected together to form a cover assembly located below worksurface 52 and enclosing lower wire management member 70 and the forwardly facing portion of upper wire management member 68. The rearwardly facing portion of upper wire management member 68, namely web 166, is normally left exposed to provide access to rearwardly facing outlets or receptacles associated with upper wire management member 68. It is understood, however, that outer access cover 72 may be constructed to fully enclose upper wire management member 68. For example, outer access cover 68 may be engageable with the upper area of upper wire management member 68 or with the underside of worksurface 52.

Outer access cover 72 generally includes an upper latch section 228, a main cover section 230, a mounting section 232 and an inner cover connection section 234.

Upper latch section 228 includes a detent ridge 236 at its inner end, which extends upwardly from a wall 238. A hinge section 240 is located between latch section 228 and the upper end of main cover section 230, which enables latch section 228 to deflect relative to main cover section 230. A living hinge 242 is located at the lower end of main cover section 230, and is formed of a resilient material which enables main cover section 230 and latch section 228 to pivot relative to mounting section 232. In this manner, main cover section 230 is movable between an open position for providing access to lower wire management member 70, and a closed position in which latch section 228 is engaged with catch member 75 mounted to the underside of upper wire management member 68, to releasably maintain main cover section 230 in its closed position. Wall 238 of latch section 228 underlies lower flange 166 of upper wire management member 68, while an upwardly extending wall 244 engages the lower end of web 166 and detent ridge 236 extends upwardly from the inner extent of lower flange 168, to engage latch section 228 with upper wire management member 68. Application of a manual outward force on outer access cover 72, in the vicinity of hinge section 240, functions to deflect latch section 228 downwardly so as to enable detent ridge 236 to pass below upper wire management member 68, to allow outer access cover 72 to be moved to its open position by pivoting movement about living hinge 242.

Mounting section 232 is configured to engage the underside of lower wire management member 70, such that outer access cover 72 is supported by lower wire management member 70. It is understood that this is but one convenient way of mounting outer and inner access covers 72, 74 below worksurface 52, and that other mounting arrangements may be employed. For example, access covers 72, 74 may be mounted to and between leg assemblies 54. In addition, while mounting section 232 has been illustrated as forming a part of outer access cover 72, it is also understood that mounting section 232 may be formed integrally with inner access cover 74.

Mounting section 232 includes an outer flange 244 having a hook 246 at its outer end, supported by a rib 248. Outer access cover 72 is preferably formed in an extrusion process, such that the various components as illustrated are formed throughout the length of outer access cover 72. In addition, mounting section 232 includes a pair of ribs 250, 252, and a flange 254 extends laterally from the upper end of rib 252. Flanges 244 and 254, as well as the upper end of rib 250, are adapted to engage the underside of bottom wall 206 of lower wire management member 70, while hook 246 is adapted to engage the rear set of mounting tabs 218 extending from the rear edge of bottom wall 206. A finger 256 having a latch 258 at its upper end extends upwardly at a location forwardly of rib 252, and latch section 258 is adapted to engage the front set of mounting tabs 218 extending from the front edge of bottom wall 206. In this manner, mounting section 232 is engageable with lower wire management member 70 with a snap-on engagement arrangement, without the need for tools. This allows access covers 72, 74 to be quickly and easily mounted to and removed from lower wire management member 70.

A T-slot 260 is formed between ribs 250 and 252, and may be employed for mounting additional components or the like to the underside of outer access cover 72.

Inner cover connection section 234 includes spaced apart wall sections 262, 264, which define a slot 266 therebetween. Wall section 264 is configured so as to extend upwardly at its inner end, to form an L-shape for slot 266.

The ends of outer access cover 72 have notches 268, to accommodate leg members 56. An end trim member 270 is engageable with each end edge of outer access cover 72 above notch 268, for providing a finished appearance to the ends of outer access cover 72.

Inner access cover 74 has an L-shaped connection section 272 at its lower end, which is adapted to be received within L-shaped slot 266 forming a part of connection section 234 of outer access cover 72. An adhesive, sonic welding or the like is employed to secure connection section 272 within slot 266, such that inner access cover 74 and outer access cover 72 are connected together.

Inner access cover 74 further includes a main cover section 274, and a living hinge 276 located at the lower end of main cover section 274 adjacent connection section 272. A finger grip section 278 extends outwardly from the upper end of main cover section 274, and a latch section 280 extends inwardly from the upper end of main cover section 274.

As noted previously, catch member 75 is mounted to the underside of worksurface 252, and latch section 280 is selectively engageable with catch member 75 to selectively maintain inner access cover 74 in its closed position. The user grips finger grip section 272 and applies an outward force, to disengage latch section 280 from catch member 75 and to pivot main cover section 274 about living hinge 276, to move inner access cover 74 to its open position. When inner access cover 74 is in its open position, the user has full access to the inner area of upper wire management member 68 as well as to lower wire management member 70. In this manner, the user is able to manipulate cables, wires, power distribution components, receptacles, etc., and to connect or disconnect cables or wires associated with equipment supported by worksurface 52.

The side edges of inner access cover 74 have cut out areas 282 to accommodate leg members 56.

Worksurface openings 76 are positioned so as to be located inwardly of upper wire management member 68, and rearwardly of catch member 75 with which inner access cover latch section 280 is engaged, such that cables or wires from equipment supported on worksurface 52 can be fed downwardly through worksurface openings 76 and into an internal space between outer and inner access covers 72, 74, respectively, forward of upper wire management member 68 and above lower wire management member 70. In this manner, such wires or cables can be plugged into receptacles associated with the power supply distribution system of upper wire management member 68 and with the voice and data communication receptacles associated with lower wire management member 70.

Figure 37:
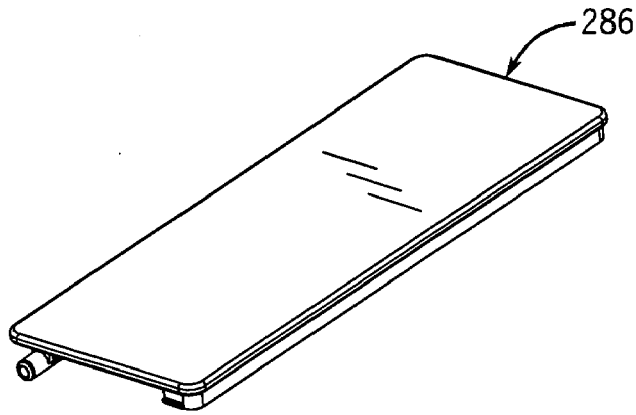
FIG. 37 is an isometric view of a cover for engagement with the grommet of FIG. 36 for selectively closing the opening of the grommet.
Figure 28:
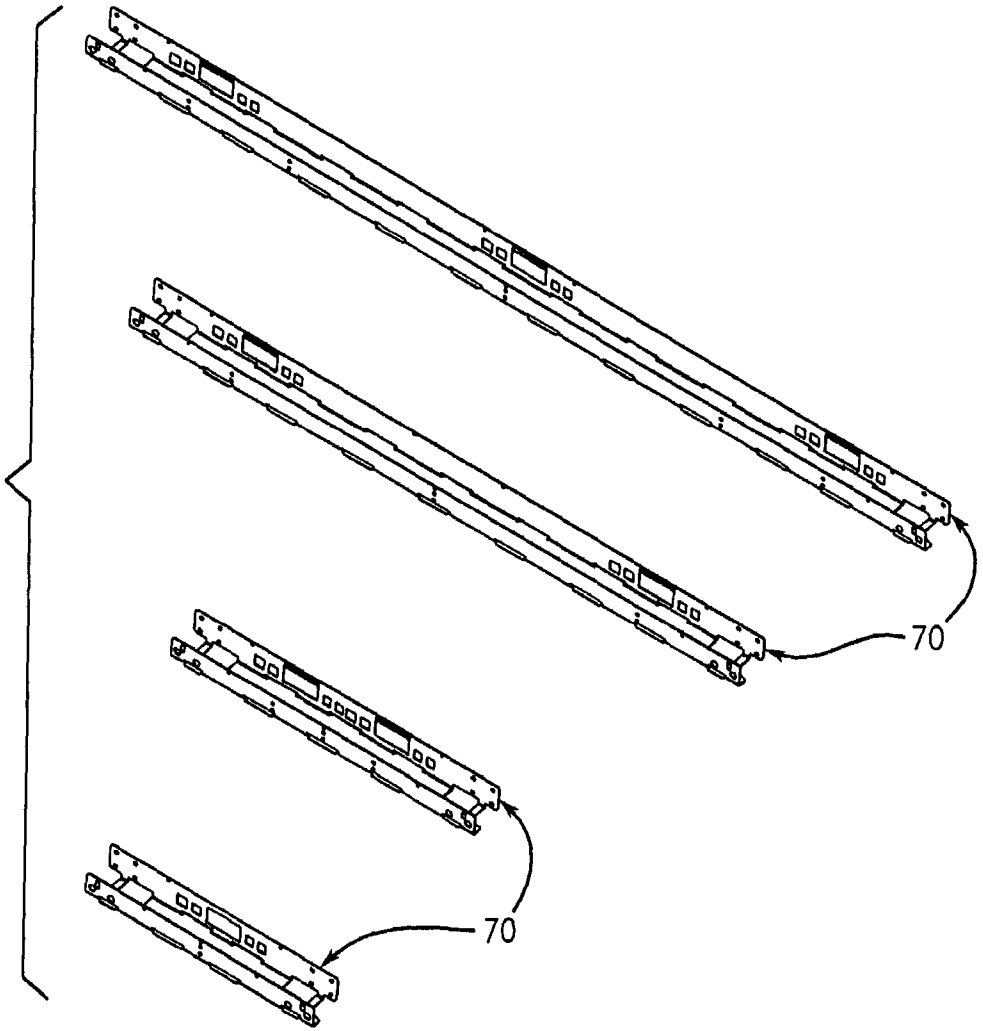
FIG. 28 is an isometric view showing various lengths of the lower wire management member as shown in FIG. 25.
Figure 29:
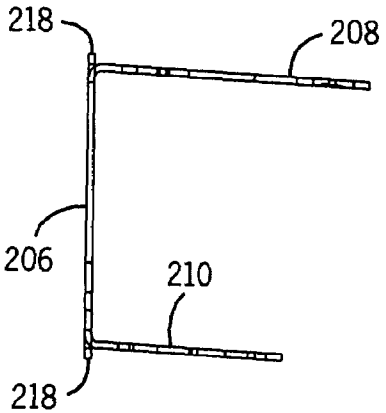
FIG. 29 is an end elevation view of one of the lower wire management members of FIG. 28.
Figure 30:
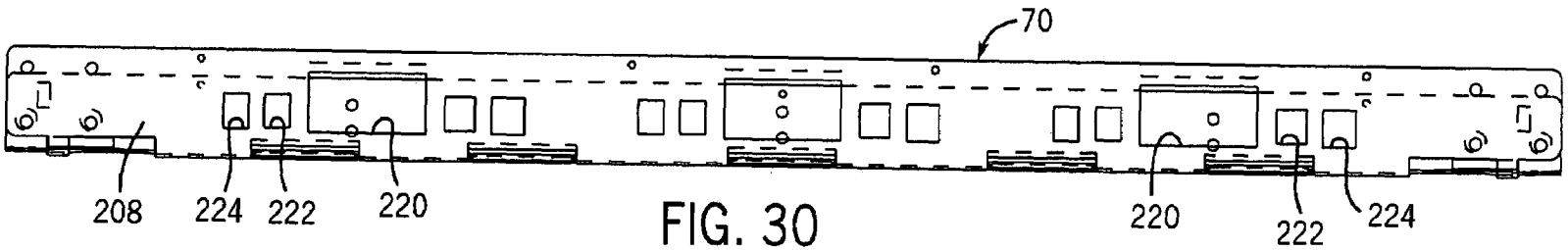
FIG. 30 is an outer side elevation view of one of the lower wire management members of FIG. 28.
Figure 31:
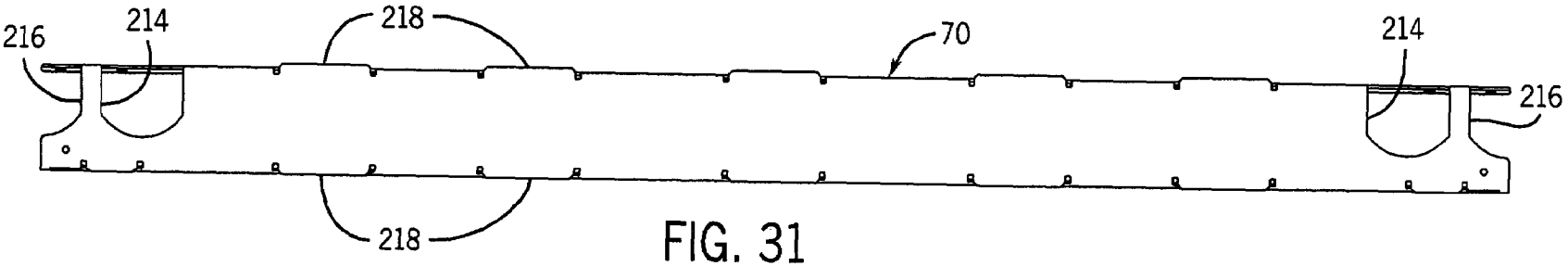
FIG. 31 is an inner side elevation view of one of the lower wire management members of FIG. 28.
Figure 33:
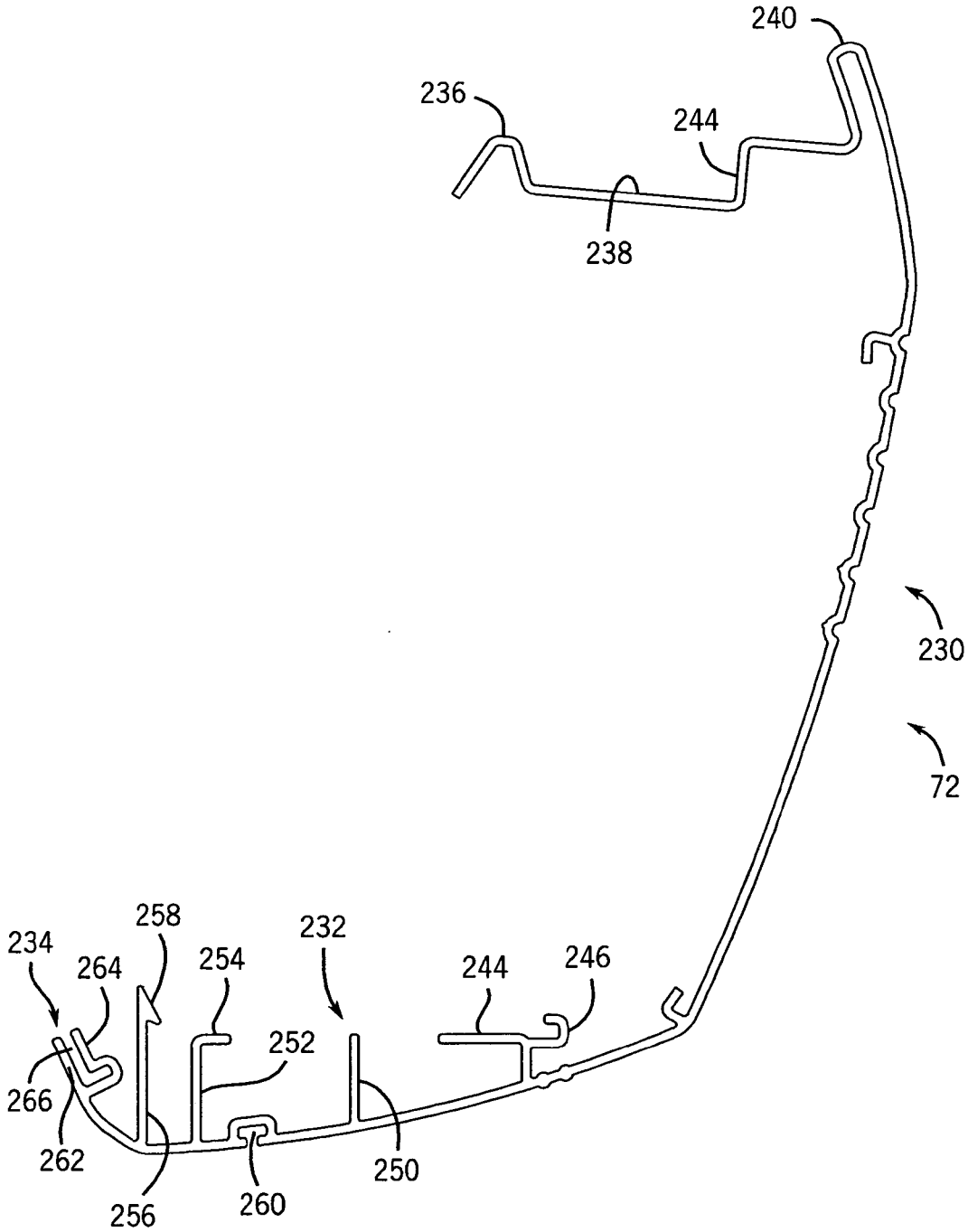
FIG. 33 is an end elevation view of the outer access cover as shown in FIG. 25.
Figure 35:
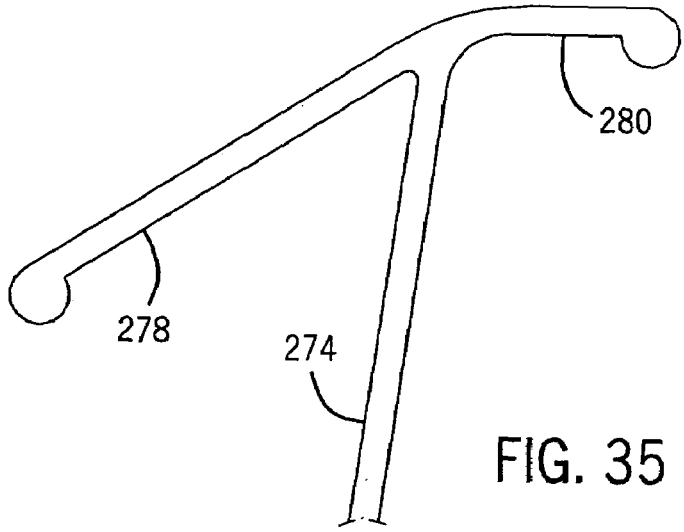
FIG. 35 is an enlarged partial end elevation view showing the upper portion of the inner access cover shown in FIG. 34.
Figure 34:
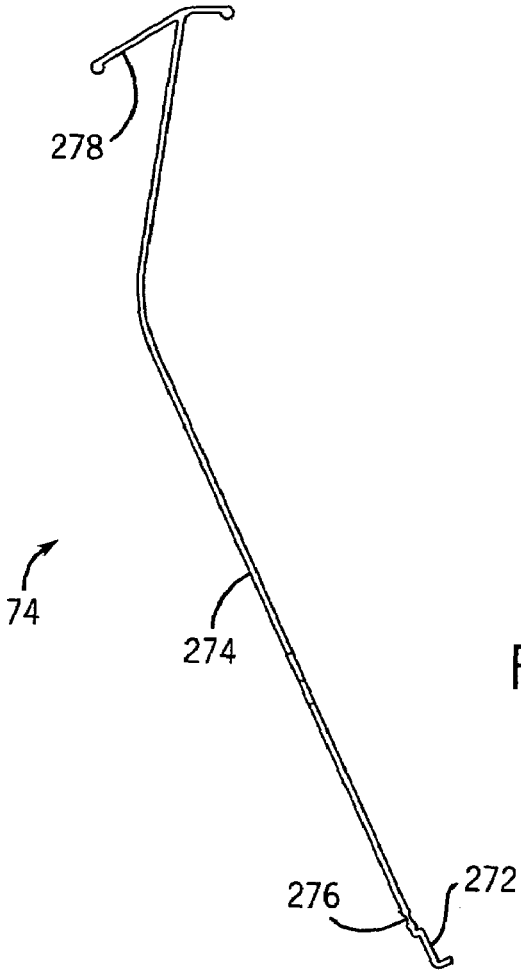
FIG. 34 is an end elevation view of the inner access cover as shown in FIG. 25.
Figure 38:
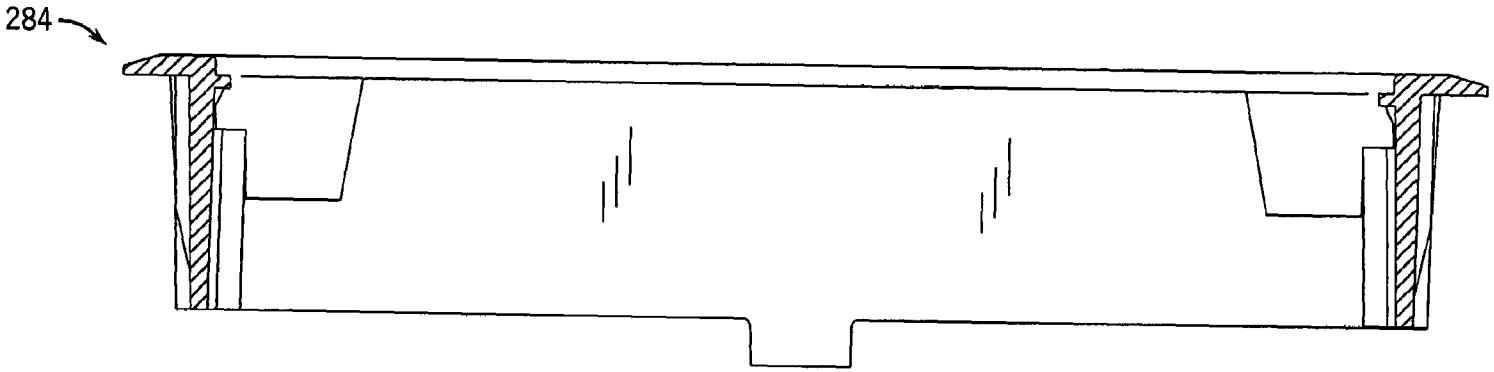
FIG. 38 is a cross-sectional view through the grommet of FIG. 36.
Figure 36:
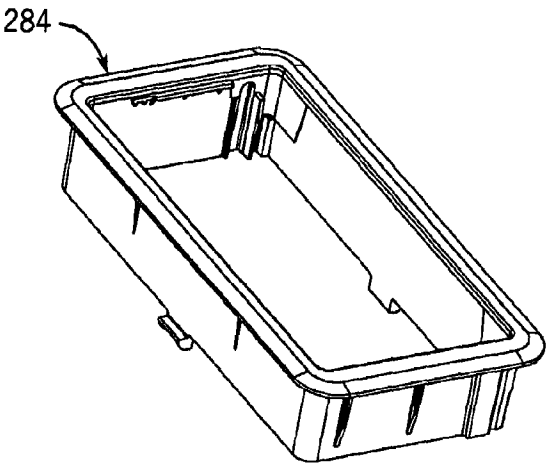
FIG. 36 is an isometric view of a grommet for engagement within the worksurface of the desk unit of FIG. 1, for enabling wires or cables to pass from the upper surface of the worksurface to an area below the worksurface.

Referring to FIGS. 36–38, a grommet 284 may be engaged within each worksurface opening 76, for providing a finished appearance to opening 76. Grommet 284 is operable to mount a flip top cover 286, which has a depth less than that of the opening defined by grommet 284, to define a space for receiving cables or wires extending through worksurface opening 76.

Various alternatives and embodiments are contemplated as being within the scope of the following claims particularly pointing out and distinctly claiming the subject matter regarded as the invention.

We claim:

1. A desk, comprising:

a worksurface supported by leg structure, wherein the worksurface defines a front, a rear, and a downwardly facing underside;

a wire management arrangement located below the worksurface, wherein the wire management arrangement comprises an upper wire management member below the underside of the worksurface and a lower wire management member spaced below the upper wire management member; and front and rear access covers, each of which is movable between an open position and a closed position, wherein the front and rear access covers are configured to provide access to the wire management arrangement from either the front or the rear of the desk, wherein at least one of the front and rear access covers comprises a pivotable unitary cover member that spans between the lower wire management member and the underside of the worksurface, wherein the unitary cover member in the open position provides access to both the upper wire management member and the lower wire management member, and in the closed position prevents access to both the upper wire management member and the lower wire management member.

2. The desk of claim 1, wherein the front access cover is the pivotable unitary cover member.

3. The desk of claim 2, wherein the rear access cover is pivotably mounted to the lower wire management member and is selectively engageable with the upper wire management member for maintaining the rear access cover in the closed position.

4. The desk of claim 3, wherein the front access cover is engageable with a catch arrangement associated with the underside of the worksurface for selectively maintaining the front access cover in the closed position.

5. The desk of claim 3, wherein the lower wire management member comprises an upwardly facing channel member defining a lower wall and a pair of spaced apart upwardly extending walls, and wherein the front and rear access covers are interconnected together and are mounted to the lower wire management member wherein the front and rear access members are spaced outwardly of the upwardly extending walls of the channel member.

6. The desk of claim 3, wherein a portion of the upper wire management member is exposed below the underside of the worksurface and above the rear access cover when the rear access cover is in the closed position, and wherein the exposed portion of the upper wire management member includes one or more power distribution receptacles that are accessible from the rear of the desk.

7. The desk of claim 3, wherein the rear access cover includes a deflectable engagement member adapted to engage a surface defined by the upper wire management member for releasably maintaining the rear access cover in the closed position.

8. The desk of claim 2, wherein the upper wire management member is adapted to support a power distribution system, and wherein the lower wire management member is adapted to support communication cables or wires.

9. The desk of claim 1, wherein the leg structure comprises a pair of legs, wherein each leg includes a foot member and a worksurface support member, wherein at least one of the legs includes an upright support member that extends between the foot member and the worksurface support member, and a wire cover located exteriorly of the upright support member and engaged therewith, wherein the wire cover defines an interior adapted to receive wires and to provide a passage for wires between the foot member and the worksurface support member.

10. The desk of claim 9, wherein the wire cover is engaged with the upright support member via a clip member secured to the upright support member and having releasable engagement structure engageable with the wire cover for releasably engaging the wire cover with the upright support member.

11. A desk, comprising:

a worksurface defining a front and a rear;

leg structure engaged with and supporting the worksurface, wherein the leg structure includes a pair of laterally spaced apart legs;

a wire management arrangement located below the worksurface, wherein the wire management arrangement includes vertically spaced apart lower and upper wire management members, wherein the lower wire management member defines a lower wire support and wherein the upper wire management member is located above the lower wire management member and defines an upper wire support;

wherein the upper wire management member is engaged with and supported by the worksurface and wherein the lower wire management member is engaged with and supported by the legs; and a cover arrangement including a first movable cover member and a second movable cover member, wherein one of the movable cover members provides access to the wire management arrangement from the rear of the worksurface and the other of the movable cover members provides access to the wire management arrangement from the front of the worksurface.

12. The desk of claim 11, wherein one of the first and second movable cover members comprises a pivotable unitary cover member that spans between the lower wire management member and an underside defined by the worksurface, wherein the unitary cover member in the open position provides access to both the upper wire management member and the lower wire management member, and in the closed position prevents access to both the upper wire management member and the lower wire management member.

13. The desk of claim 12, wherein the pivotable unitary cover member comprises a front one of the movable cover members, and wherein the upper wire management member and rear one of the movable cover members are configured to provide access to the lower wire management member when the rear movable cover member is in the open position and to prevent access to the lower wire management member when the rear movable cover member is in the closed position.

14. The desk of claim 13, wherein the rear movable cover member and the upper wire management member include releasable retainer structure for releasably maintaining the rear movable cover member in the closed position.

15. The desk of claim 13, wherein the upper wire management member includes an upstanding, rearwardly facing mounting wall, wherein one or more electrical power receptacles are adapted for engagement with the mounting wall, and wherein the rear movable cover member is configured to engage the upper wire management member below the mounting wall such that at least a portion of the mounting wall including the one or more electrical power receptacles is exposed between the first movable cover member and the worksurface when the first movable cover member is in the closed position.

16. The desk of claim 12, wherein the first and second movable cover members are mounted to the lower wire management member for movement between the open and closed positions.

17. The desk of claim 16, wherein the first movable cover member is engageable with the upper wire management member to maintain the first movable cover member in the closed position, and wherein the second movable cover member is engageable with the underside defined by the worksurface to maintain the second movable cover member in the closed position.

18. The desk of claim 11, wherein the lower wire management member defines an upwardly open channel for receiving wires in a lay-in manner.

* * * * *